US009666171B2

(12) United States Patent
Martin

(10) Patent No.: US 9,666,171 B2
(45) **Date of Patent: *May 30, 2017**

(54) DRUM MOUNTING AND TUNING SYSTEM PROVIDING UNHINDERED AND ISOLATED RESONANCE

(71) Applicant: August D. Martin, Albuquerque, NM (US)

(72) Inventor: August D. Martin, Albuquerque, NM (US)

( * ) Notice: Subject to any disclaimer, the term of this patent is extended or adjusted under 35 U.S.C. 154(b) by 202 days.

This patent is subject to a terminal disclaimer.

(21) Appl. No.: 14/536,606

(22) Filed: Nov. 8, 2014

(65) Prior Publication Data

US 2015/0059553 A1 Mar. 5, 2015

Related U.S. Application Data

(63) Continuation-in-part of application No. 14/092,400, filed on Nov. 27, 2013, now Pat. No. 8,884,144, which is a continuation of application No. 13/857,924, filed on Apr. 5, 2013, now Pat. No. 8,629,340.

(51) Int. Cl.
*G10D 13/02* (2006.01)

(52) U.S. Cl.
CPC ..... *G10D 13/023* (2013.01); *G10D 13/022* (2013.01)

(58) Field of Classification Search
CPC ..... G10D 13/026; G10D 13/02; G10D 13/00; G10D 13/021; G10D 13/023; G10H 2230/275; G10H 2230/281
USPC ..... 84/411 R, 421
See application file for complete search history.

(56) References Cited

U.S. PATENT DOCUMENTS

| | | | |
|---|---|---|---|
| 1,212,126 | A | 1/1917 | Canfield |
| 3,981,220 | A | 9/1976 | Clark |
| 4,295,405 | A | 10/1981 | Sleishman |
| 4,448,105 | A | 5/1984 | Cordes |
| 4,520,709 | A | 6/1985 | Kester, Jr. |
| 4,660,455 | A | 4/1987 | Jones et al. |

(Continued)

OTHER PUBLICATIONS

International Search Report and Written Opinion for PCT/US2014/032867, Aug. 15, 2014, 17 pages.

*Primary Examiner* — Kimberly Lockett
(74) *Attorney, Agent, or Firm* — Los Angeles Patent Group; Arman Katiraei

(57) ABSTRACT

Some embodiments provide a drum structural framework comprising a top shell mount, bottom shell mount, rod holders, and tension rods. The top shell mount and bottom shell mount are mounted to either ending edge of a drum shell disposed between the two mounts. A first set of the rod holders are coupled to the top shell mount and an aligned second set of the rod holders are coupled to the bottom shell mount. The tension rods link the two sets of rod holders without hindering resonance of the drum shell. Tuning assemblies on the rod holders adjust the distance separating the top shell mount from the bottom shell mount, thereby controlling the force imposed on the drum shell. Each rod holder includes one or more dampeners that isolate energy passing from the drumhead to the shell from also reverberating throughout the structural framework of the tension rods and rod holders.

16 Claims, 21 Drawing Sheets

(56) References Cited

U.S. PATENT DOCUMENTS

| | | | | |
|---|---|---|---|---|
| 4,714,002 | A | 12/1987 | Cleland | |
| 4,833,964 | A | 5/1989 | Prouty | |
| 4,869,146 | A | 9/1989 | Bonsor | |
| 5,410,938 | A | 5/1995 | Kurosaki et al. | |
| 5,447,087 | A | 9/1995 | Hawes et al. | |
| 5,834,667 | A | 11/1998 | Midkiff | |
| 7,138,574 | B1 | 11/2006 | Spinazzola | |
| 7,491,877 | B1 | 2/2009 | Cherny | |
| 7,501,567 | B1 | 3/2009 | Spinazzola | |
| 8,188,355 | B2 | 5/2012 | Tochilin | |
| 8,629,340 | B1 * | 1/2014 | Martin | G10D 13/023 84/411 R |
| 2007/0283797 | A1 | 12/2007 | Crawford et al. | |
| 2009/0038465 | A1 | 2/2009 | Whalley et al. | |
| 2014/0026732 | A1 | 1/2014 | Spinazzola et al. | |
| 2014/0053708 | A1 | 2/2014 | Spinazzola et al. | |

* cited by examiner

DRUM MOUNTING AND TUNING SYSTEM PROVIDING UNHINDERED AND ISOLATED RESONANCE

CLAIM OF BENEFIT TO RELATED APPLICATIONS

This application is a continuation-in-part of the U.S. non-provisional application Ser. No. 14/092,400, entitled "Drum Mounting and Tuning System Providing Unhindered and Isolated Resonance", filed Nov. 27, 2013 which is a continuation of the U.S. non-provisional application Ser. No. 13/857,924, entitled "Drum Mounting and Tuning System Providing Unhindered and Isolated Resonance", filed Apr. 5, 2013, now U.S. Pat. No. 8,629,340. The contents of application Ser. Nos. 14/092,400 and 13/857,924 are hereby incorporated by reference.

TECHNICAL FIELD

The present invention pertains to musical instrument structure and design and, more specifically, to drum structure and design.

BACKGROUND

Artistic expression can be conveyed in any one of several mediums including music. Musical instruments provide the tools with which to express musicality. Drums or percussions instruments in general are one such tool.

Drum structure and design has remained consistent over several generations. This consistent structure and design has preserved the sound quality that initial incarnations of the instrument produced. While standard and commonplace today, the sound produced by drums constructed according to the conventional structure and design is one that is deadened or muted. This is because of structural features that are integrated into the drum shell that impede the shell's ability to resonate and produce a full and rich sound.

FIG. 1 illustrates drum structure and design common in the prior art. The drum is composed of a pair of drum hoops or rims, a shell, a set of lugs, and a corresponding set of lug holders attached across the side of the drum shell.

The interior of each hoop contains the drumhead. The drumhead is the contact surface that vibrates when stricken during play. For a typical drum, the drumhead on the top side of the drum, sometimes called the batter head, is the part of the drum that a drummer strikes when playing the instrument. The drumhead on the bottom side of the drum provides resonance and is usually thinner than the drumhead on the top side.

Tuning assemblies on the drum hoop can be used to adjust the tension on the drumhead, thereby tuning the drumhead sound and also allowing different drumheads to be coupled to the shell mount. The drum hoop also contains various openings through which the set of lugs can pass through to connect to the corresponding set of lug holders that are attached across the side of the drum shell.

The shell is the body of the drum. It creates much of the sound characteristics of the drum based in part on the resonance of the materials from which the drum shell is constructed. When the drumhead is impacted, the drumhead vibrates. When the drum hoop is tightly coupled to the drum shell using the lug fastening system, the vibrations channel from the drumhead to the containing hoop and are dispersed across the shell. These vibrations then cause the drum shell to resonate which, in turn, produces some of the drum's sound characteristics. Often, the drum shell includes a small hole referred to as the vent hole. The vent hole allows air to escape when the drum is struck, which in turn improves the resonance of the drum.

However, conventional drum structure and design as shown by FIG. 1 impedes this resonance. This is due to the attachment of the lug holders 110 across the drum shell. Specifically, when the lugs are placed into the lug holders and tightened in order to couple the drum hoop to the shell, a force is exerted on the lug holders based on how tightly the lugs are tightened. The force is then borne onto the drum shell along the points at which the lug holders are connected to the shell. This force pulls the drum shell in at least one direction, preventing the drum shell from fully resonating in the opposite direction(s), and thereby deadening or muting the overall sound produced by the drum.

Conventional drum structure and design further hinders the sound that can be produced by the drum by limiting the current manufacturing and production of the drum shell to dense materials such as metal (e.g., steel or brass), wood (e.g., birch, maple, oak, etc.), and acrylic as some examples, to thicker construction, or some combination of both. The density of the drum shell material and thickness of the drum shell are needed to prevent the drum shell from warping or breaking when absorbing and counteracting the forces imposed by the tensioning of the lugs from the drum hoop to the lug holders attached along the side of the drum shell. This results in a lot of force on the drum shell. It is for this reason that some shells are manufactured with a thickness of up to 20 millimeters. In these instances, more energy is needed to induce resonance from such shells. Also, the density and thickness causes the drum shell to vibrate at a higher intrinsic frequency. Accordingly, the sound profile produced by the drum is defined and limited to the resonate characteristics that these dense or thicker materials provide. The full potential spectrum of a drum shell's sound is unattainable unless a drum shell of reduced thickness or less dense materials are used in the drum shell composition and the drum shell is allowed to resonate freely. Both of these attributes would require less sound energy from a stricken drumhead to generate resonation from a drum shell. Thus, this would provide a drum a more efficient resonating sound profile.

In an attempt to remedy some of these shortcomings, alternative drum designs have been proposed. One such alternative design is provided in U.S. Pat. No. 5,410,938. The provided design frees the resonance of the drum shell by use of tension rods that span from the top side drum hoop (i.e., batter side) to the bottom side drum hoop and by coupling the rod holders to the hoops instead of the drum shell. This design improves the potential resonate characteristics of the drum shell, but does so by imposing other tradeoffs in the sound quality of the drum. Specifically, this design produces a distorted and impure sound because vibrations from the drumhead disburse not only across the drum shell but also into each of the tension rods. Consequently, the tension rods absorb vibrations each time the drumhead is struck causing the tension rods to produce additional undesired sounds (i.e., rattling) along with the expected drum sound. These undesired sounds are the result of a failure to isolate the mounting or tuning mechanisms (i.e., tension rods and rod holders) from the sound producing elements of the drum (i.e., drumhead and shell).

Accordingly, there is a need for a new drum structure and design that provides pure and unimpeded sound by allowing the drum shell to resonate freely without distortion or dampening from mounting or tuning mechanisms attached across the side of the drum shell. In other words, there is a need for a new drum structure and design wherein the supporting framework couples together the sound producing elements of the drum in a manner that shields the sound energy emanating from the sound producing elements from the supporting framework. By addressing these needs, one can produce a drum with unparalleled sound. Drum design can further improve the sound profile of the drum by addressing the need to reduce the forces that are imposed on the drum shell. In so doing, such a design would allow for shells constructed from thinner materials to be incorporated into the drum construction with the drum shell offering greater resonance and different sound characteristics than their thicker or more dense counterparts.

SUMMARY OF THE INVENTION

It is an objective to provide a drum structural framework that disburses energy from the drumhead to a freely resonating drum shell while reducing or completely isolating the same energy from reverberating throughout the structural framework. It is therefore an objective to provide a drum structural framework that achieves a pure drum sound profile in which the resonance of the drum shell is unimpeded and distortion and other undesired sounds from the structural framework are eliminated.

These and other objectives are achieved by the ultimount structural framework of some embodiments. The ultimount structural framework is comprised of a top shell mount, bottom shell mount, rod holders, and tension rods. Unique to the ultimount rod holders is the integrated dampening solution that contains the energy imposed during play on the sound producing elements while reducing or completely isolating that same energy from reverberating through the non-sound producing elements of the structural framework.

The top shell mount comprises a die-cast hoop, a bearing edge ring, and a tension ring. The top shell mount secures and tunes a first drumhead of the drum to the drum shell without hindering resonance of the drum shell. The bottom shell mount comprises a complementary die-cast hoop, bearing edge ring, and tension ring that secures and tunes a second drumhead also without hindering resonance of the shell. Specifically, a first set of the rod holders are coupled to the top shell mount and an aligned second set of the rod holders are coupled to the bottom shell mount. The tension rods link the first set of the rod holders to the corresponding second set of rod holders. Tuning assemblies on the rod holders can be used to adjust the distance separating the top shell mount from the bottom shell mount, thereby controlling the compression force imposed on the drum shell. The compression force holds the drum shell in place without hindering resonance of the drum shell, because the drum shell itself is only contacted along its top and bottom distal edges by the underside of the top shell mount and the bottom shell mount. The free resonance of the drum shell produces a richer and fuller sound profile as compared to other designs in which extraneous forces placed on the drum shell deaden the sound by obstructing the resonance of the drum shell. These extraneous forces typically manifest when lug holders or other forces are disposed along the side of the drum shell. An additional undesired byproduct of these extraneous forces is the need for a thicker drum shell. The greater the thickness of the drum shell, the greater the amount of energy needed to induce resonance and produce sound. However, since the design advocated herein removes any such extraneous forces from the drum shell, thinner drum shells or drum shells using less dense materials that were previously inapt, such as plastic, clay, and glass, can now be used. Consequently, a new evolution in drum sound is opened.

Moreover, each rod holder couples to either the top shell mount or bottom shell mount with one or more isolation rings that serve as vibration dampeners. The dampeners isolate energy passing from the drumhead to the drum shell from also reverberating throughout the structural framework of the tension rods and rod holders holding together the drumhead and drum shell. This prevents the tension rods and other structural framework elements from vibrating or creating other undesired sound or reverberation that would otherwise pollute the sound profile of the drum.

BRIEF DESCRIPTION OF THE DRAWINGS

In order to achieve a better understanding of the nature of the present invention a preferred embodiment of the ultimount structural framework will now be described, by way of example only, with reference to the accompanying drawings in which.

DETAILED DESCRIPTION OF THE INVENTION

Figure 1:
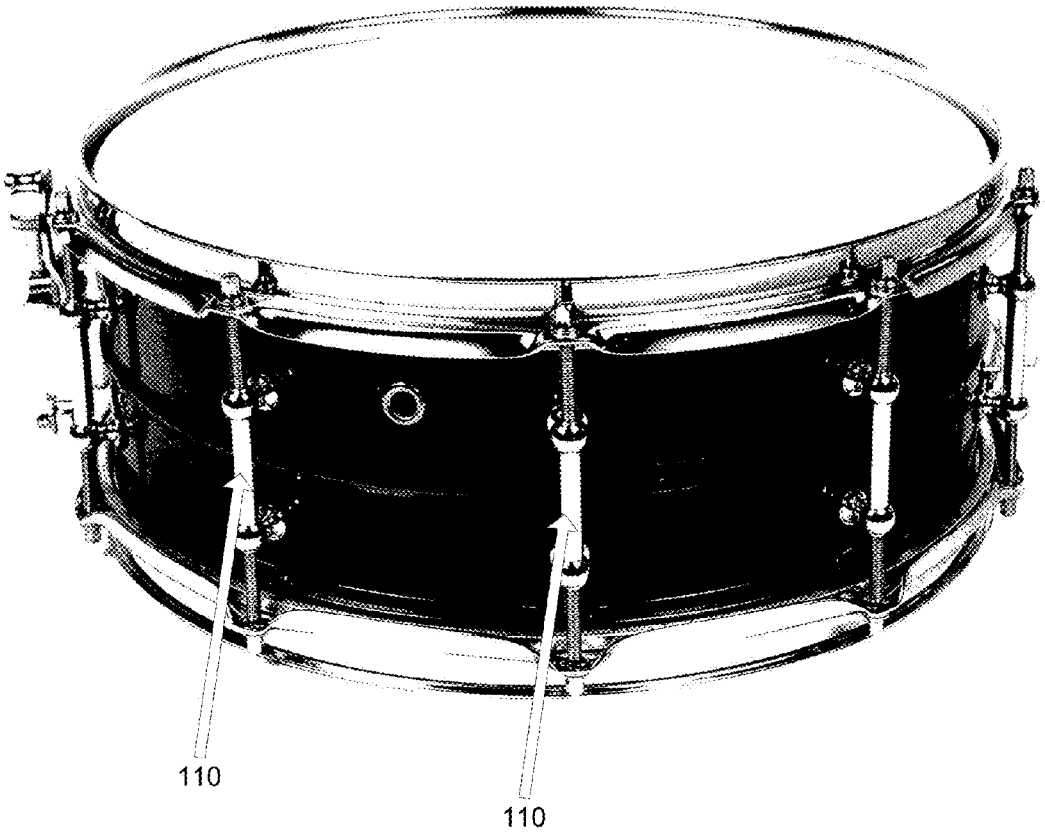
Prior Art Figure 1
FIG. 1 illustrates drum structure and design commonplace in the prior art.
Figure 2:
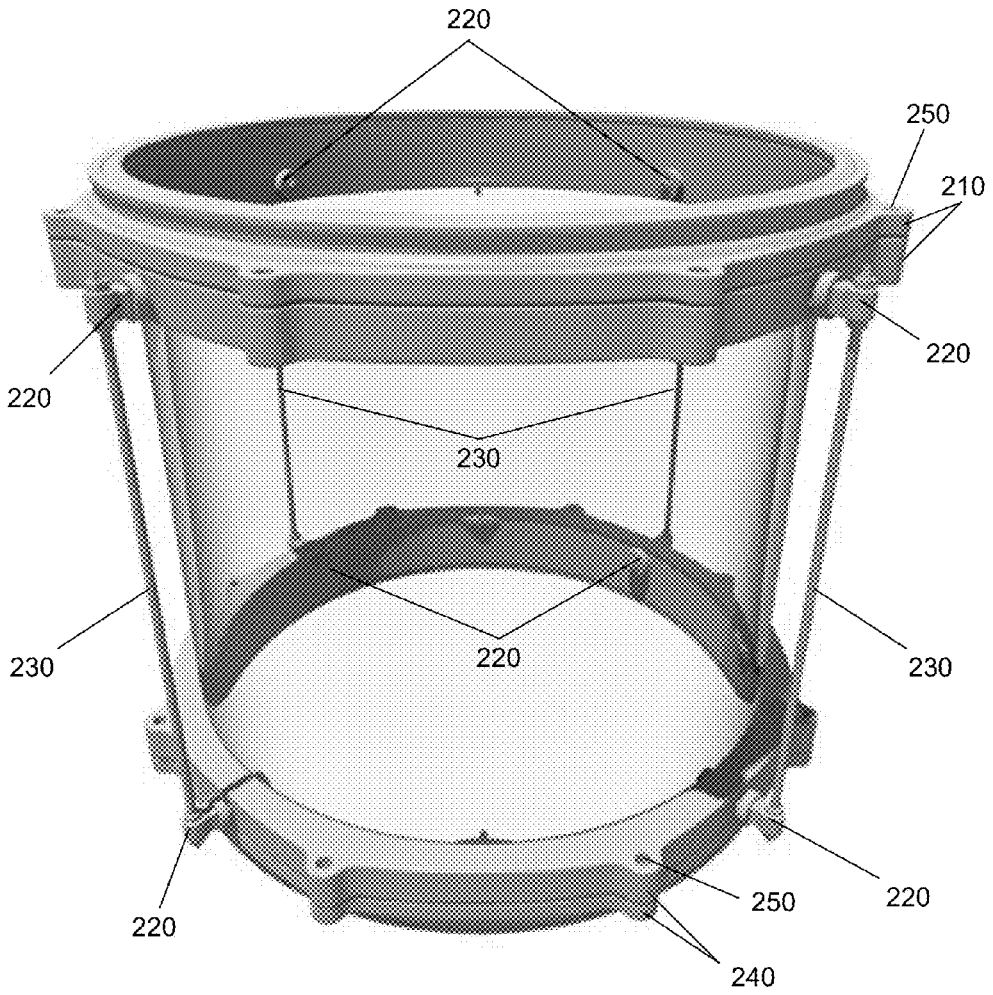
FIG. 2 illustrates the ultimount drum design and structure of some embodiments.

FIG. 2 illustrates the ultimount drum design and structure of some embodiments. In differing from drum designs and structures of the prior art, the ultimount couples the drumhead to the drum shell in a manner that does not hinder resonance of the drum shell and in a manner that isolates the non-sound producing supporting framework from the sound producing drumhead and shell. In so doing, the ultimount provides several advantages over drum designs and structures of the prior art. First, the ultimount provides a richer and fuller sounding drum because the ultimount does not hinder resonance of the drum shell during play. Second, the ultimount eliminates undesired sound and distorted sound from the overall sound profile of the drum because of the isolation of the structural framework from the sound producing elements of the drum. Third, the ultimount allows for the manufacture of entirely new drum shells because the ultimount removes extraneous forces that are imposed on the drum shell by other frameworks, thereby allowing the drum shell to be manufactured with thinner construction and/or less dense materials, thus providing better resonance.

As shown in FIG. 2, the ultimount structural framework includes top shell mount 210, rod holders 220, tension rods 230, and bottom shell mount 240. This structural framework couples the drumhead to the shell. More importantly, this structural framework ensures that sound energy imposed on the drumhead during play is disbursed to an unhindered and freely resonating drum shell without reverberating throughout the structural framework and without causing distorted or undesired sound.

Figure 3:
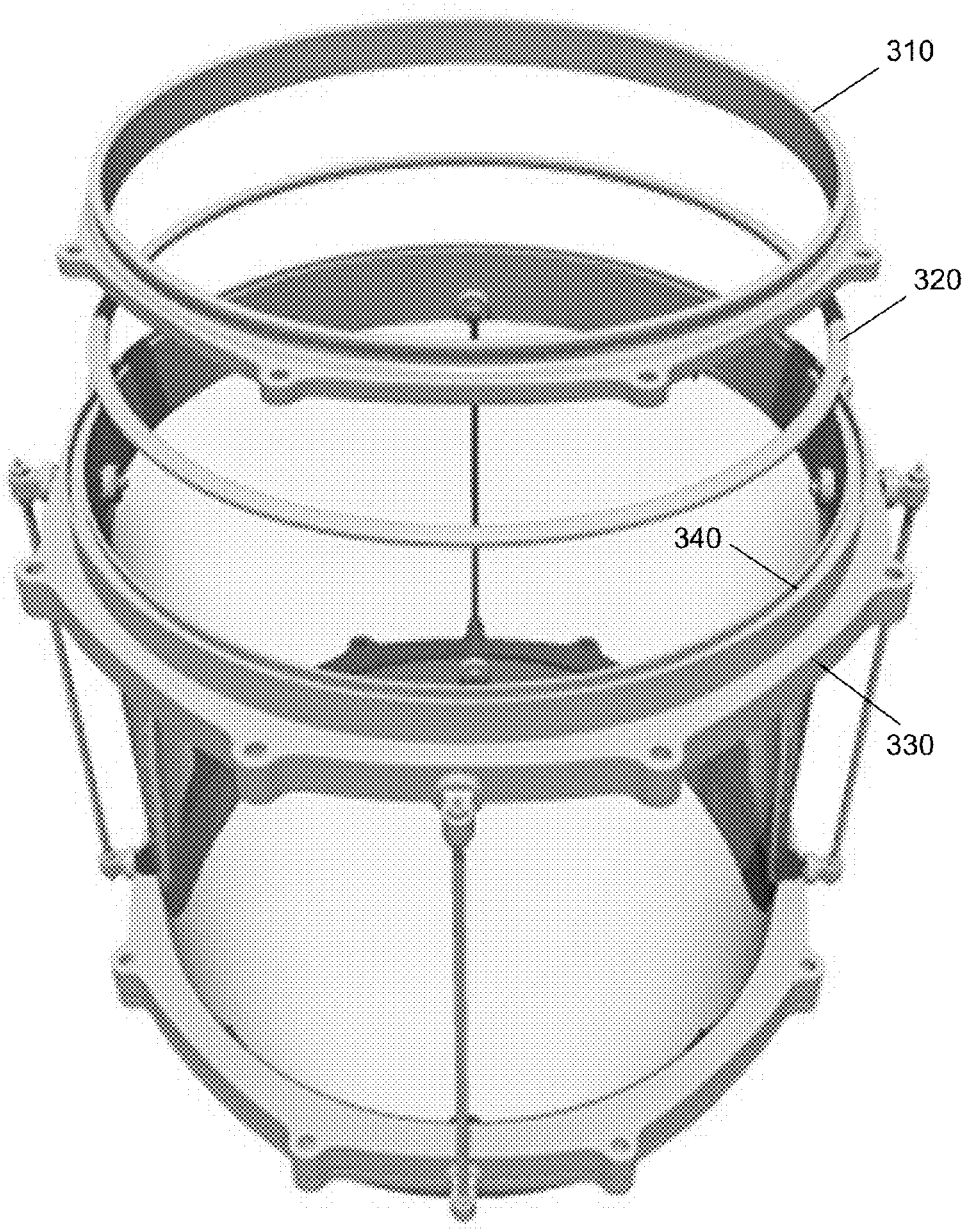
FIG. 3 provides a partially exploded view of the ultimount structural framework to illustrate the die-cast hoop, bearing edge ring, and tension ring of the top shell mount.
Figure 4:
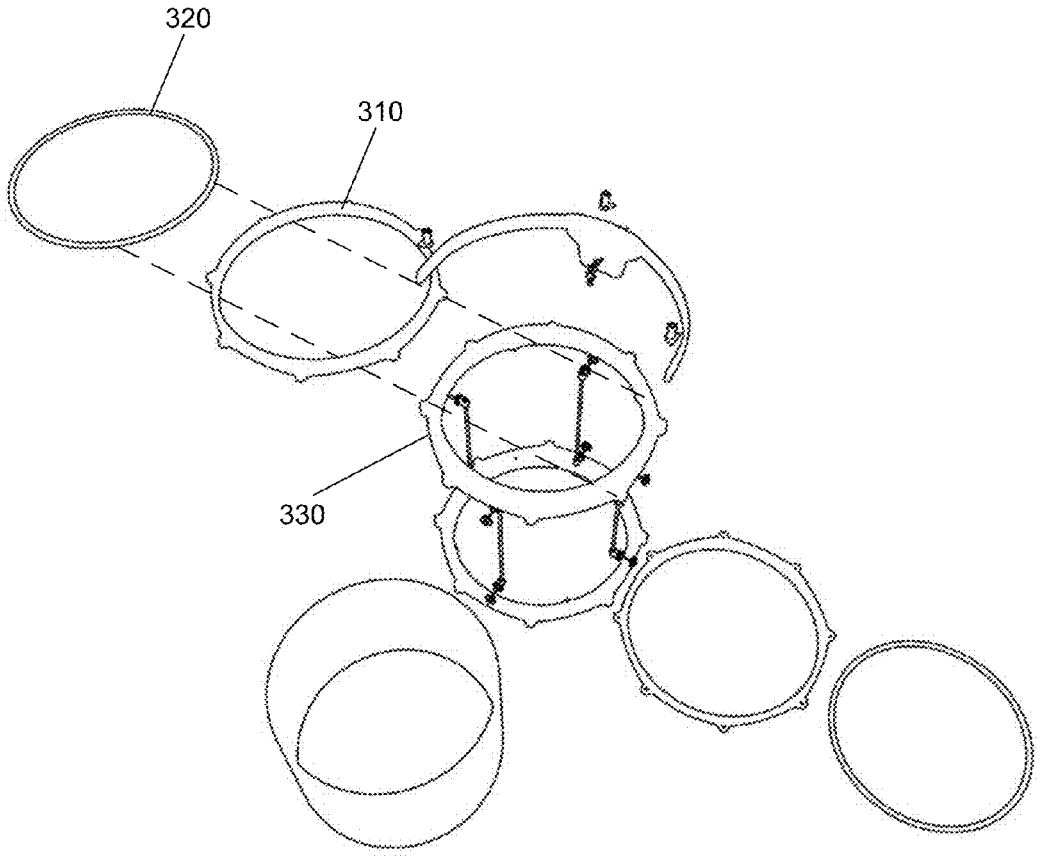
FIG. 4 provides an alternate exploded view illustrating the die-cast hoop, bearing edge ring, and tension ring of the top shell mount.

The top shell mount 210 and bottom shell mount 240 are constructed from a rigid material, such as metal (e.g., brass, steel, etc.) or carbon fiber. Each shell mount 210 and 240 is comprised of a die-cast hoop, a bearing edge ring, and a tension ring. FIG. 3 provides a partially exploded view of the ultimount structural framework to illustrate the die-cast hoop 310, bearing edge ring 320, and tension ring 330 of the top shell mount 210. FIG. 4 provides an alternate exploded view illustrating the die-cast hoop 310, bearing edge ring 320, and tension ring 330 of the top shell mount 210. For simplicity, the die-cast hoop is interchangeably referred to as the upper ring and the tension ring is interchangeably referred to as the lower ring.

The lower ring or tension ring 330 mounts atop the outer lip of the drum shell. The tension ring 330 has a hollowed inner cavity with a recessed groove 340 running centrally along the ring circumference.

Figure 5:
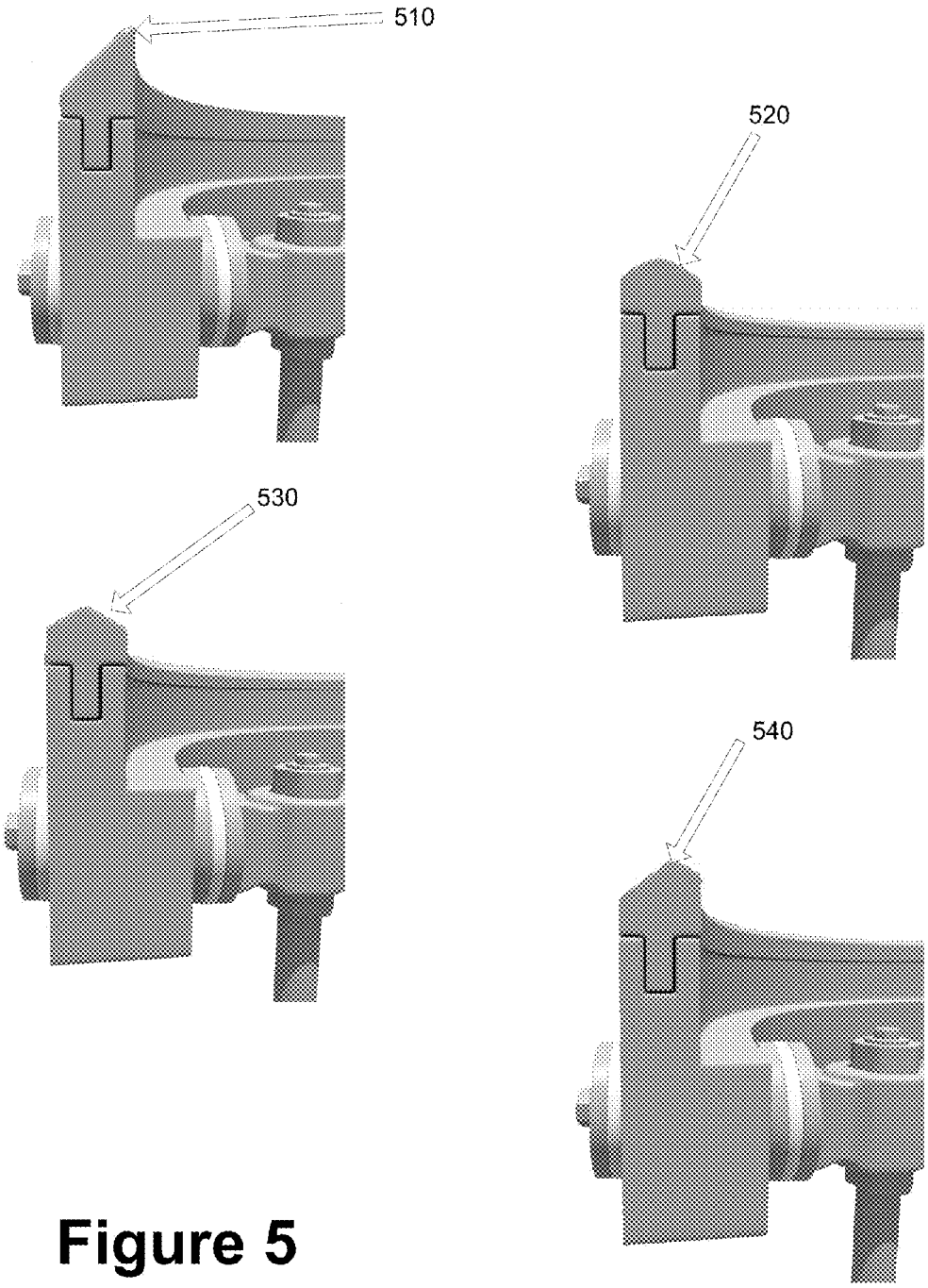
FIG. 5 provides cross sectional views of different bearing edge rings that can be inserted within the tension ring with each bearing edge ring cut at a different angle in accordance with some embodiments.

The bearing edge ring 320 has a downward extruding edge that allows the bearing edge ring 320 to sit within the recessed groove of the tension ring 330 and to aid in precise drum tuning. As such, the bearing edge ring 320 is easily interchangeable, thereby allowing the ultimount framework to accommodate bearing edges that are cut at a variety of angles with each angle changing the tonality of the drum, and more generally, altering the sound profile. Some embodiments provide a bearing edge cut at 30 degrees and other embodiments provide a bearing edge cut at 45 degrees. When the drumhead is disposed atop the 30 degree bearing edge, tuned, and played, the resulting sound has a mellow attack and a low amount of sustain, whereas when the drumhead is disposed atop the 45 degree bearing edge, tuned, and played, the resulting sounds has a lot of attack and a lot of sustain. These angles are provided for exemplary purposes. Accordingly, the ring 320 is not limited to these angles and can be cut at any other angle. FIG. 5 provides cross sectional views of different bearing edge rings 510, 520, 530, and 540 that can be inserted within the tension ring with each bearing edge ring 510, 520, 530, and 540 cut at a different angle in accordance with some embodiments.

The interchangeability of the bearing edge ring 320 within the tension ring 330 provides the user with quick, simple, and cost-effective means with which to alter the sound profile of the drum. The interchangeability also allows a first bearing edge ring cut at a first angle to be inserted within the tension ring of the top shell mount and a second bearing edge ring cut at a second different angle to be inserted within the tension ring of the bottom shell mount. The bearing edge ring 320 can be made of steel, brass, wood, or carbon fiber as some examples.

As noted above, the drumhead is disposed atop the bearing edge ring 320 and the upper ring or die-cast hoop 310 is placed over the drumhead and secured to the tension ring 330. Typically, the die-cast hoop 310 is enlarged relative to the tension ring 330 so as to fit around the outer circumference of the tension ring 330. Tension on the drumhead is adjusted by tightening or loosening a set of screws or lugs that pass through holes along the die-cast hoop 310 and screw into a corresponding set of threaded holes along the outer edge of the tension ring 330. Examples of these threaded holes are illustrated in FIG. 2 by reference markers 250. The tighter the die-cast hoop 310 is secured to the tension ring 330, the greater the force that is exerted on the drumhead. Adjusting this force controls how taut the drumhead becomes, thereby tuning the sound of the drumhead. In some embodiments, a torque wrench can be used to tighten the screws or lugs and thereby achieve a desired level tension on the drumhead. Different drumheads can be inserted between the top shell mount 210 and the bottom shell mount 240. As such, the drum can be played as a "tom" at one end or drumhead at the top side or batter side of the drum and as a "snare" at the other end for example.

Figure 6:
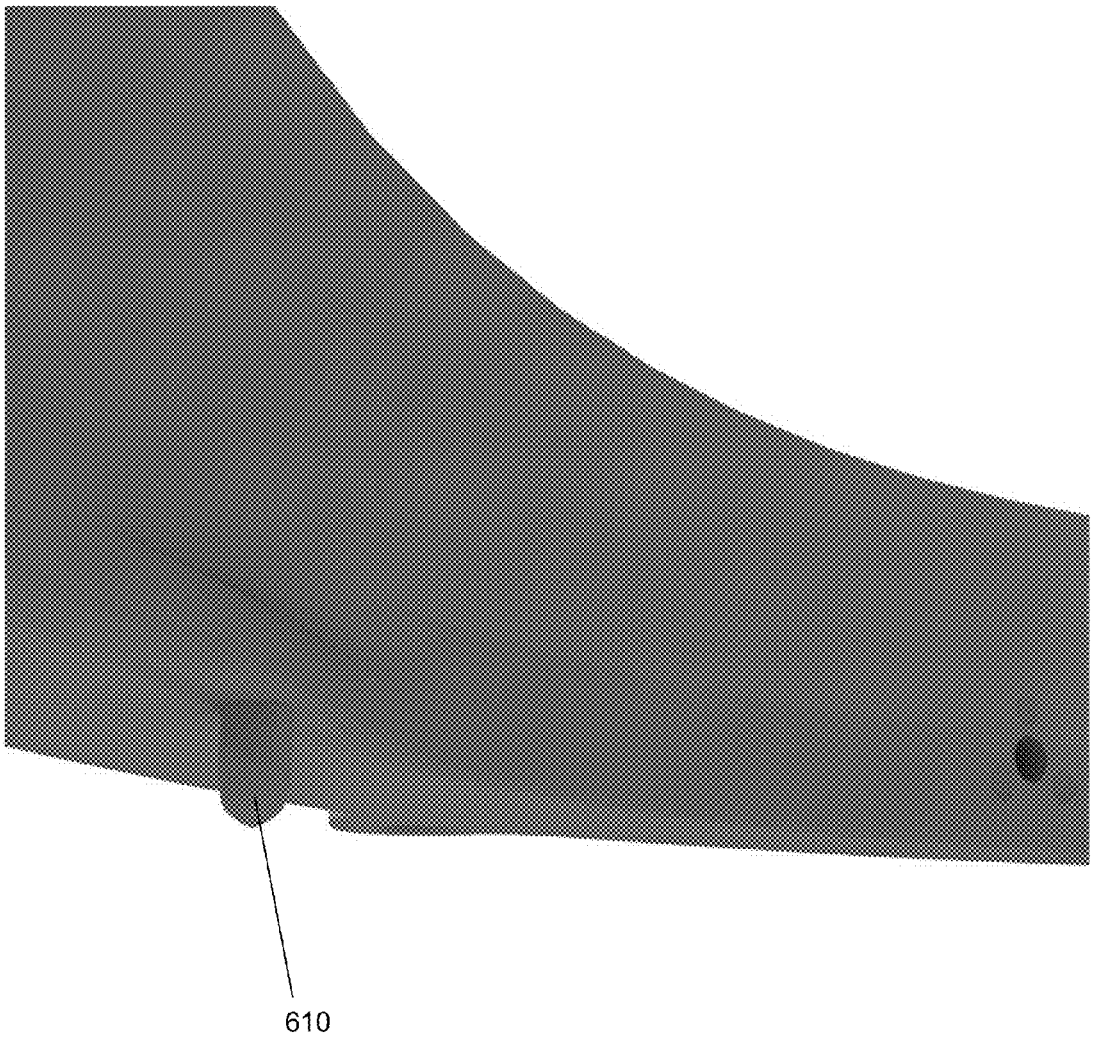
FIG. 6 illustrates a tension ring with at least one guide.

In some embodiments, the tension ring 330 includes one or more guides to aid in coupling the shell mount to the drum shell. FIG. 6 illustrates a tension ring with at least one guide 610. The guide 610 is a protrusion extending from the underside of the tension ring interior. The guides are used to align the tension ring directly over the drum shell by positioning along the interior of the drum shell circumference.

The tension ring 330 or lower ring of each shell mount 210 and 240 serves a dual purpose. As noted above, the first purpose involves coupling with the die-cast hoop 310 to hold and tune the drumhead. The second purpose involves coupling the drumhead to the drum shell in order to disburse sound energy from the drumhead to the drum shell while preventing that same energy from reverberating throughout the structural framework. The sound energy isolation is achieved based on the design and structure with which the vibration is isolated from the rod holders 220 and tension rods 230 coupled to the tension ring 330 of each shell mount 210 and 240.

In some embodiments, the tension ring 330 has a width and height of 5 to 30 millimeters such that when the tension ring 330 is positioned over the end edge of the drum shell, the tension ring 330 extends some millimeters over the plane of the end edge and away from the center of the shell. In some other embodiments, the tension ring 330 extends vertically below the plane of the end edge and towards the center of the drum shell based on a covering that protrudes from the tension ring 330 at a radius greater than that of the shell rim. In either configuration, multiple apertures are drilled across the circumferential face of the tension rings.

With reference back to FIG. 2, a first set of the rod holders 220 couple to the tension ring of the top shell mount 210 at the provided apertures. Similarly, a second set of the rod holders 220 couple to the tension ring of the bottom shell mount 240 at the provided apertures. The rod holders 220 are unique relative to those of the prior art because of their vibration isolating design and structure. The holders 220 reduce or completely isolate energy that is imposed on the drumhead during play from the structural framework holding the drum together and more specifically, from the tension rods 230. This prevents the tension rods 230 from rattling or creating other undesired sound during play.

Figure 7:
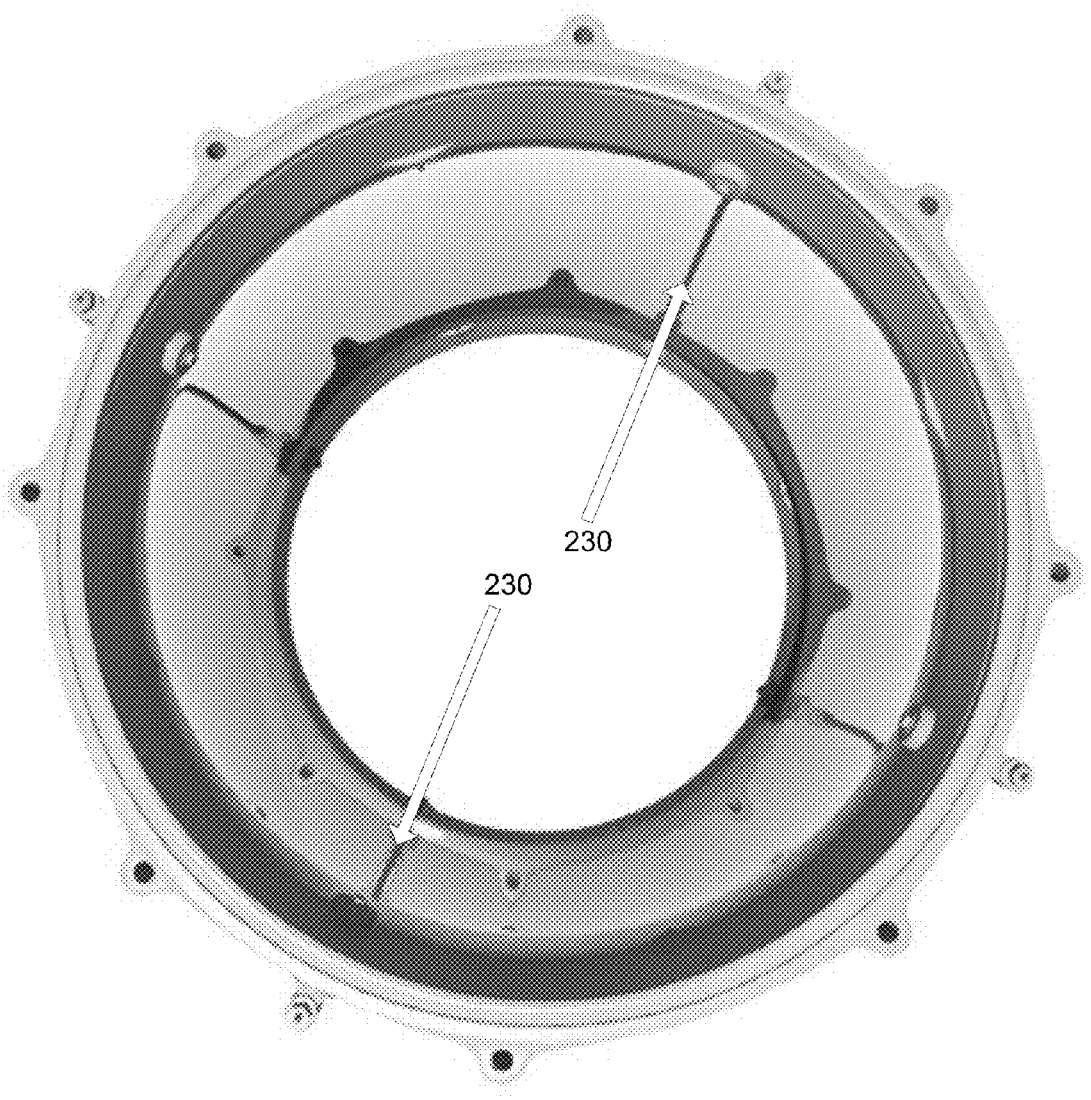
FIG. 7 illustrates the ultimount drum design and structure with a set of interior facing rod holders that dispose the tension rods within the interior of the drum shell.

In the embodiment shown in FIG. 2, the rod holders 220 are exterior facing such that the tension rods 230 span lengthwise along the exterior of the drum shell. However, other embodiments, such as the one depicted in FIG. 7, comprise a structural framework in which the rod holders 220 are interior facing such that the tension rods 230 span lengthwise within the interior of the drum shell.

Figure 8:
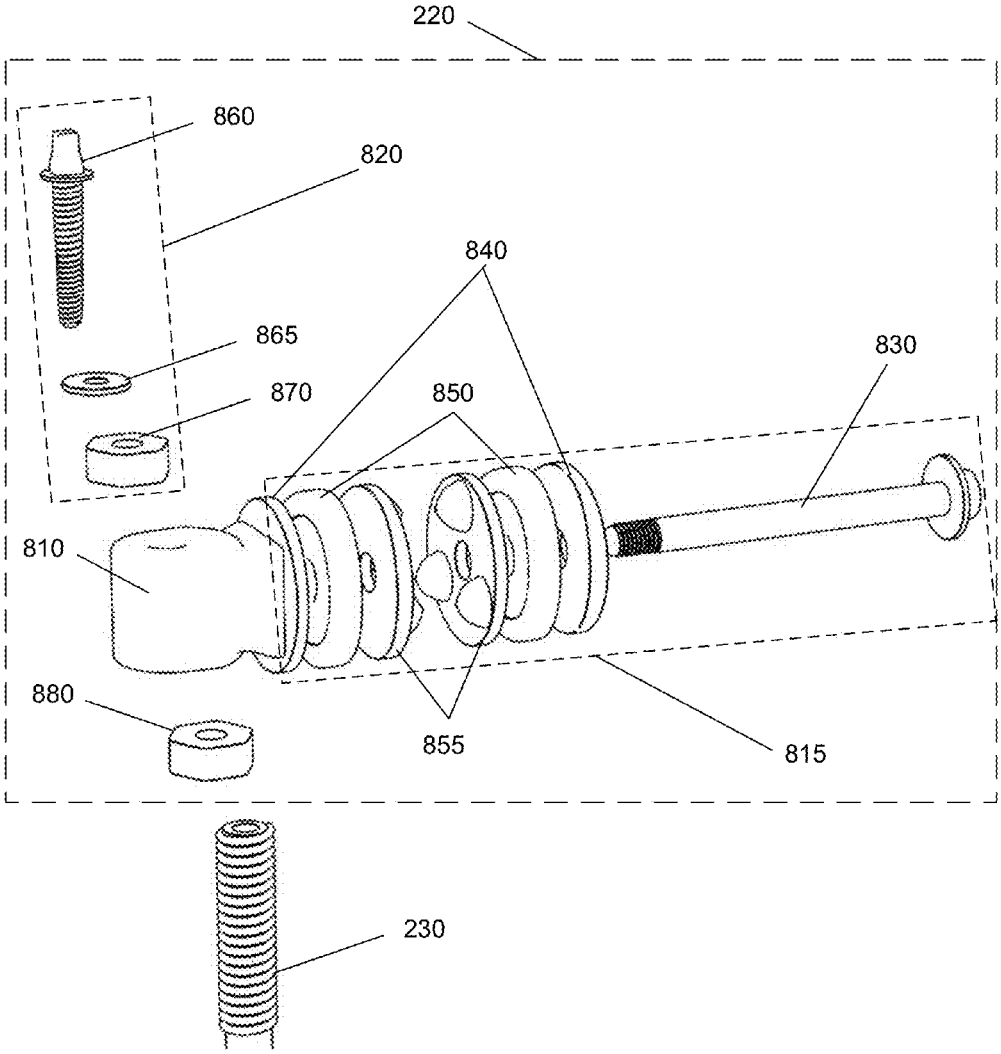
FIG. 8 illustrates an exploded view of a rod holder in accordance with some embodiments.

An exploded view of a rod holder 220 in accordance with some embodiments is provided in FIG. 8 to demonstrate the structural elements that isolate sound energy from reverberating through the ultimount structural framework. As shown, the rod holder 220 is composed of a three faceted binding anchor 810, a vibration dampening assembly 815, and a tension assembly 820.

The three faceted binding anchor 810 includes a horizontal threaded aperture that is used in conjunction with the vibration dampening assembly 815 to secure the rod holder 220 to one of the shell mounts and to isolate the structural framework from the drumhead and drum shell. The three faceted binding anchor 810 also includes bilateral vertical apertures. One end of the bilateral vertical aperture accepts a tension rod 230. The tension rod 230 passes through to the other end where it is then secured using a threaded nut 870 of the tension assembly 820.

The vibration dampening assembly 815 includes a bolt 830, spacers 840, dampeners 850, and gripped endcaps 855. In some embodiments, the endcaps 855 and spacers 840 are made from metal for structural integrity or carbon fiber for high tensile strength. The dampeners 850 are made from absorbing and dampening materials. In some embodiments, the dampeners 850 are isolating rings made of rubber, although other materials such as carbon fiber can also be used. In some other embodiments, the endcaps 855 and spacers 840 are also made from absorbing and dampening materials to compliment the dampening provided by the isolating ring dampeners 850.

The vibration dampening assembly 815 secures the rod holder 220 to one of the shell mounts 210 and 240 and, more importantly, prevents the impact energy that is placed on the drumhead from passing through the ultimount structural framework that holds the drum together.

To do so, a gripped endcap 855 is positioned on either side of an aperture along the circumferential face of one of the tension rings. Each gripped endcap 855 includes a set of conical protrusions that minimize the surface contact with the circumferential face of the tension ring. Minimizing the contact surface between the gripped endcaps 855 and the circumferential face minimizes the amount of energy that gets transferred to the structural framework, thereby minimizing the amount of energy that must be dampened within the structural framework. Also, by minimizing the amount of energy that gets transferred to the structural framework, more of the energy is preserved and passed to the drum shell resulting in fuller and less muted sound. In some embodiments, the circumferential face of the tension ring includes a set of recessed guides for the set of conical protrusions of the endcaps 855. A dampener 850 in the form of an isolating ring or bushing is positioned along the opposite side of either gripped endcap 855. Lastly, a spacer 840 is positioned on either side of the dampeners 850. In some embodiments, each of the endcaps 855, dampeners 850, and spacers 840 can be convex or concave in shape depending on whether it is positioned along the interior or exterior of the tension ring.

Each of the endcaps 855, dampeners 850, and spacers 840 has a circular opening in their respective center that is sized to accommodate the bolt 830. Once the elements are positioned, the bolt 830 is passed through each of the elements with the aperture of the tension ring being at the center of the arrangement. The bolt 830 is screwed into the horizontal threaded aperture of the three faceted binding anchor 810. This then secures the rod holder 220 to the tension ring of either the top shell mount 210 or bottom shell mount 240. Furthermore, it establishes the necessary contact to allow the dampeners 850 to absorb and prevent energy from passing into the structural framework.

The endcaps 855, dampeners 850, and spacers 840 are also sized according to the radial height of the tension ring to which they are attached. In some embodiments, the radial height changes based on the drum shell size (or diameter) and the corresponding size of the shell mount that fits the drum shell. The different sized endcaps 855, dampeners 850, and spacers 840 ensure proper dampening by providing sufficient contact between the tension ring and the vibration dampening assembly 815 while avoiding components that are over-sized such that they extend beyond the radial height of the tension or are undersized such that they pass through rather than engage the aperture along the circumferential face of the tension ring. This also ensures that the conical protrusions of the endcaps 855 fit within the recessed guides along the circumferential face of the tension ring when the guides are present.

Figure 9:
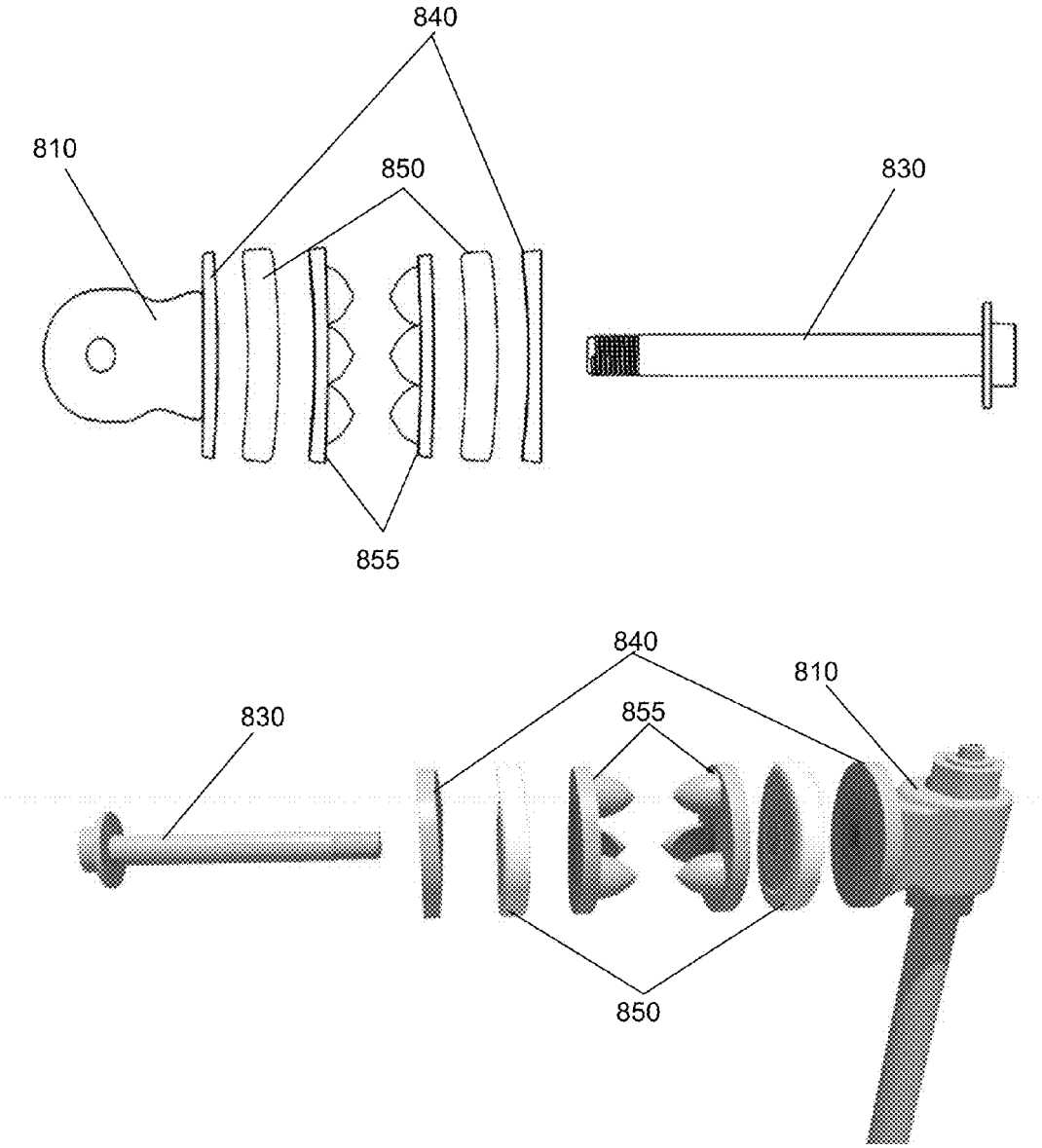
FIG. 9 provides another exploded view for the vibration dampening assembly of some embodiments.
Figure 10:
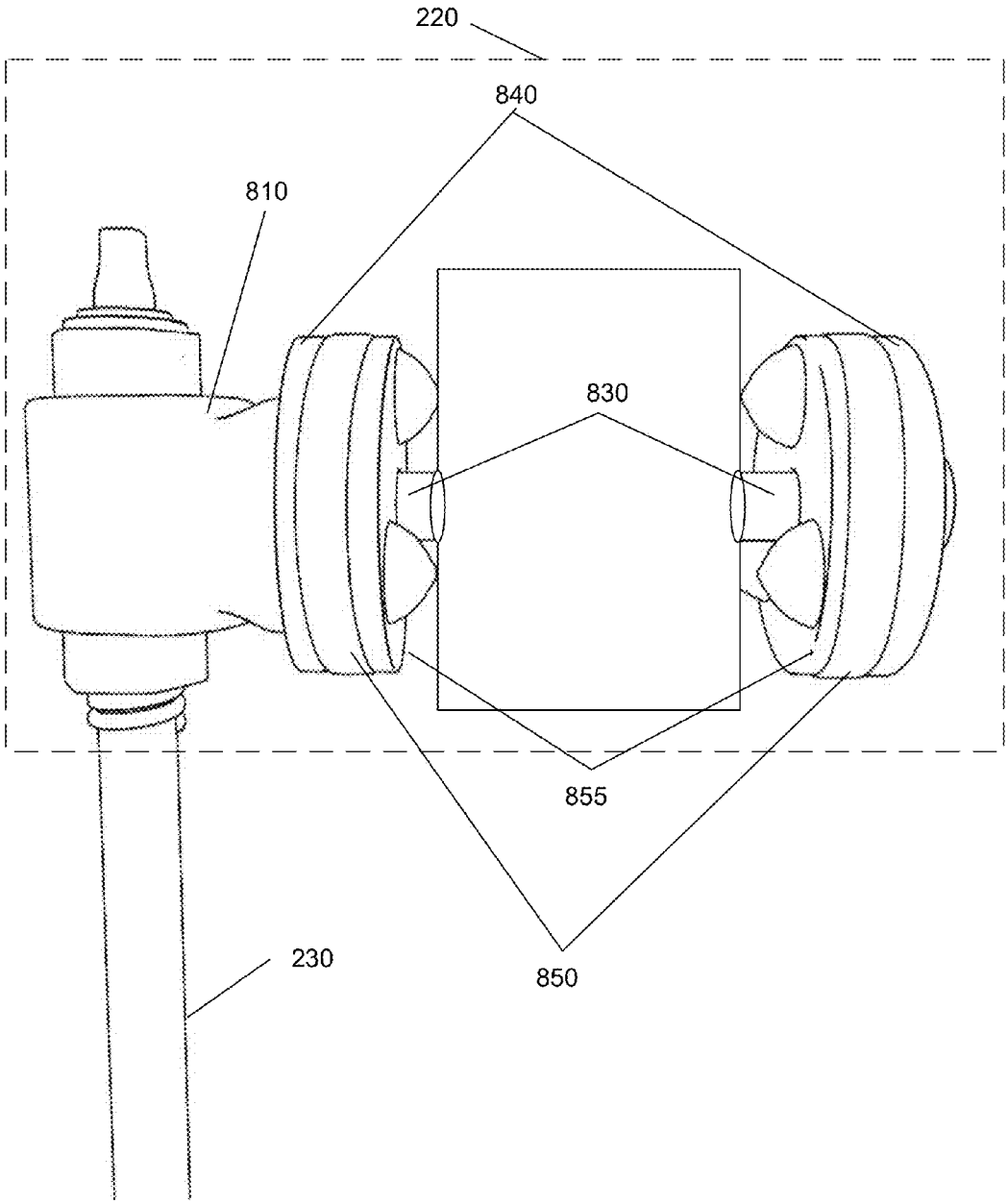
FIG. 10 illustrates a completed vibration dampening assembly.
Figure 11:
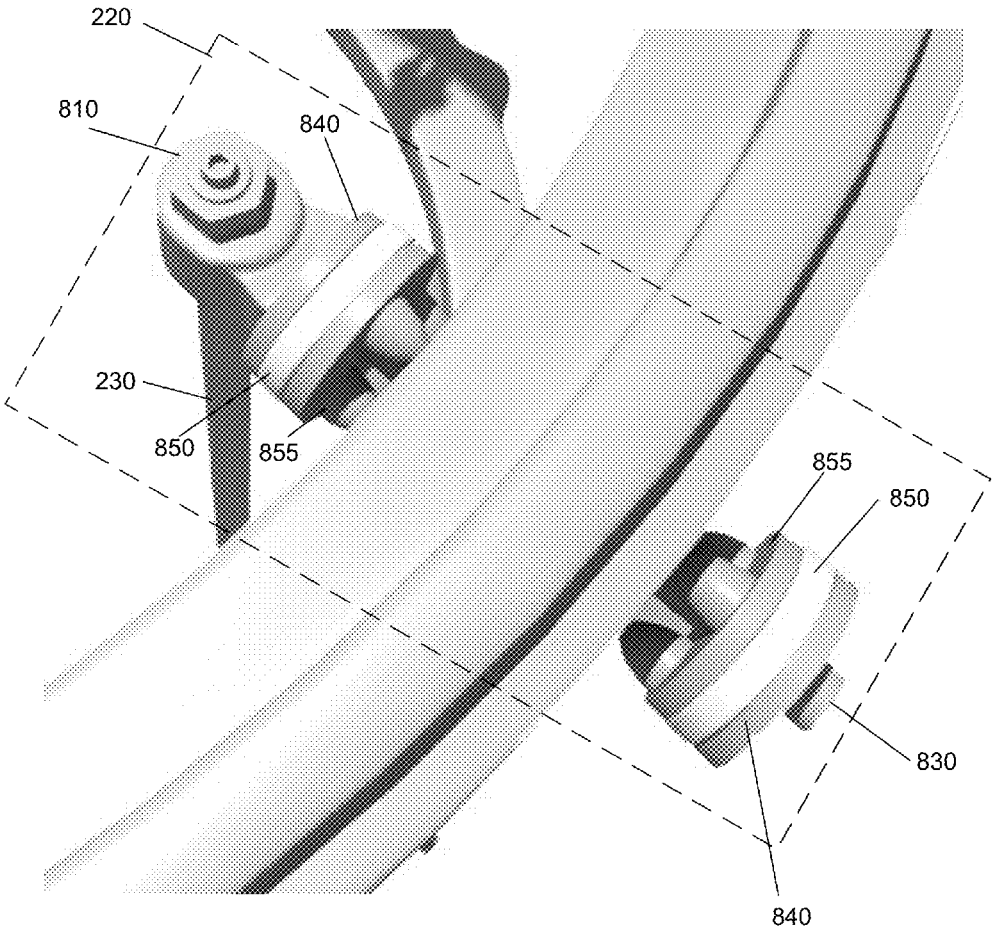
FIG. 11 provides an alternate rendering for a completed vibration dampening assembly secured to one of the shell mounts in accordance with some embodiments.

FIG. 9 provides another exploded view for the bolt 830, spacers 840, dampener 850, and gripped endcaps 855 that comprise the vibration dampening assembly 815 of the rod holders 220. FIG. 10 illustrates a completed vibration dampening assembly secured to one of the shell mounts 210 or 240. FIG. 11 provides an alternate rendering for a completed vibration dampening assembly secured to one of the shell mounts 210 or 240 in accordance with some embodiments.

Figure 12:
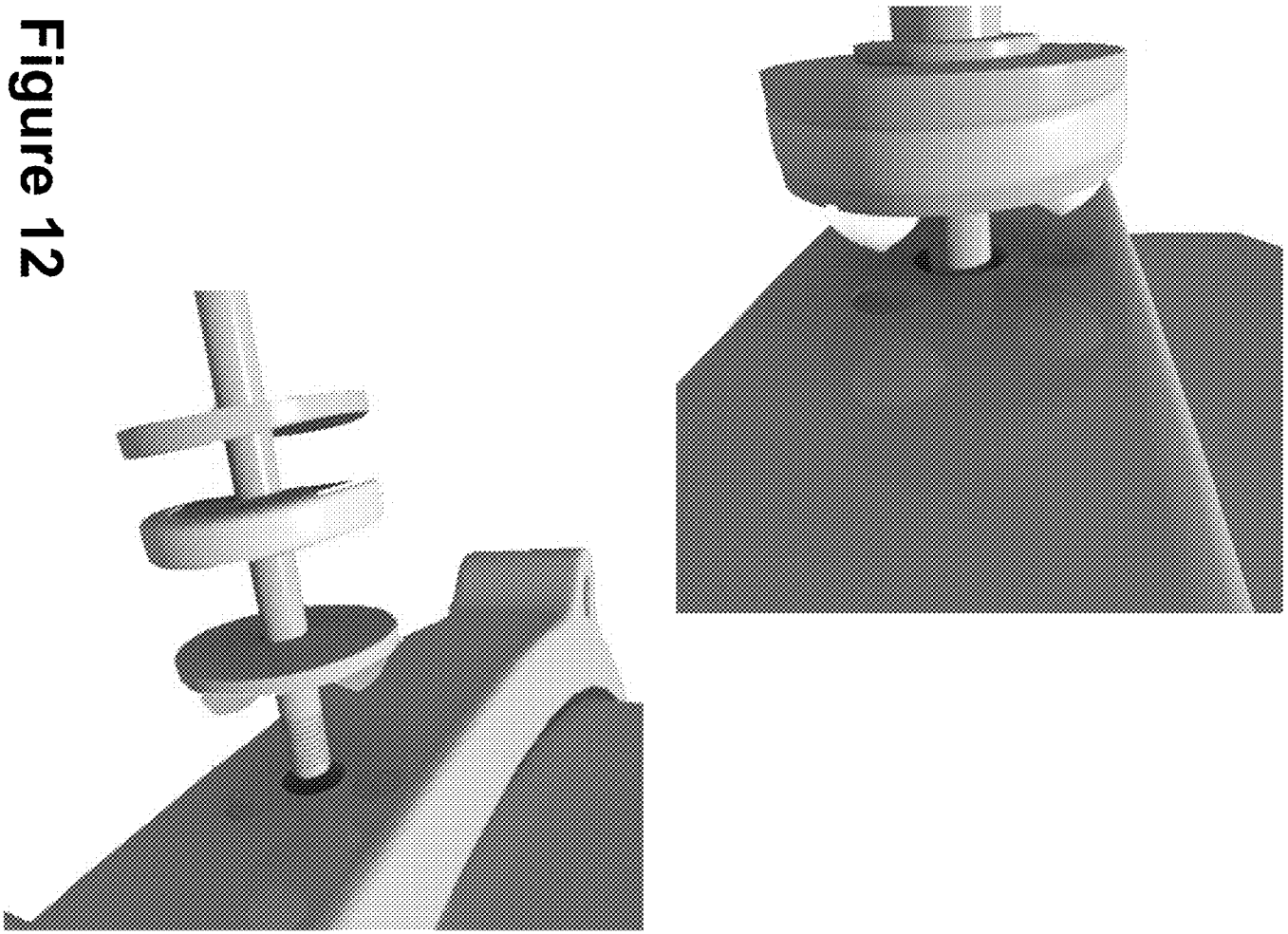
FIG. 12 provides two views illustrating an oversized tension ring aperture in accordance with some embodiments.

In some embodiments, the aperture of the tension ring is slightly larger than the bolt 830. The additional spacing in the tension ring aperture allows air to escape when the drum is struck, thereby providing venting and improved resonance. In some embodiments, the circumferential face of FIG. 12 provides two views illustrating an oversized tension ring aperture in accordance with some embodiments.

Figure 13:
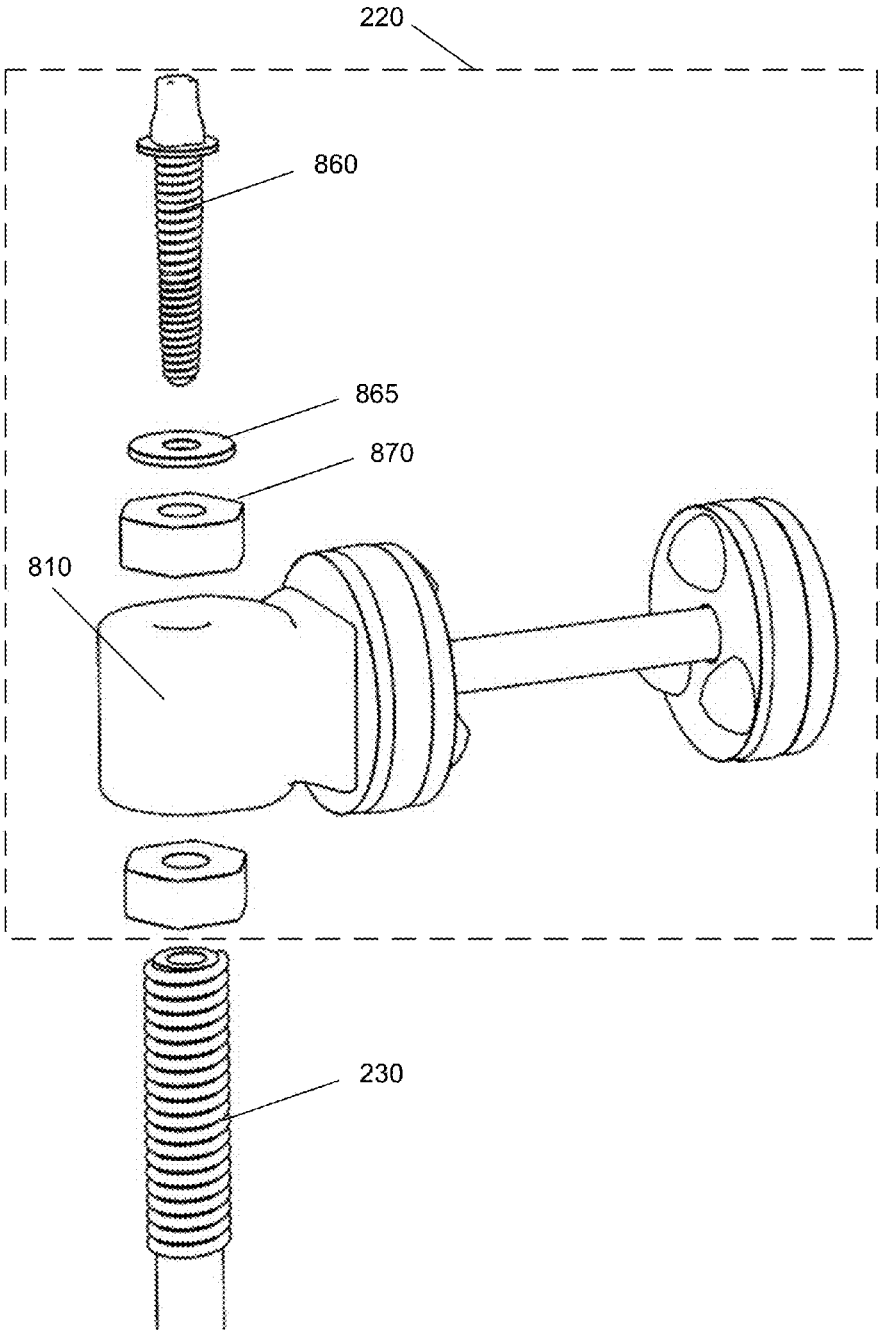
FIG. 13 illustrates an exploded view for the tension assembly of some embodiments.
Figure 14:
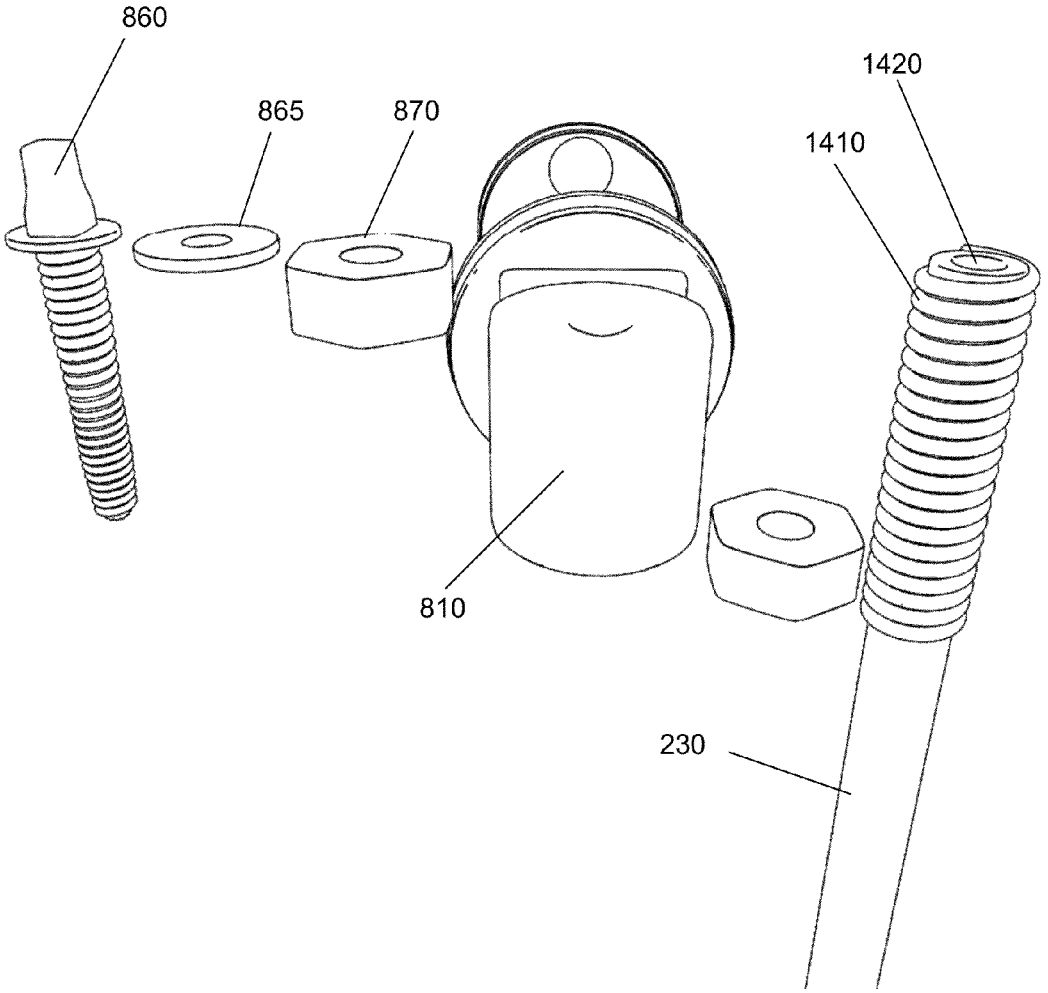
FIG. 14 provides an alternative staggered exploded view for the tension assembly of some embodiments.

With reference back to FIG. 8, the tension assembly 820 is comprised of a top bolt 860, a washer 865, and a threaded nut 870. FIG. 13 illustrates an exploded view for the tension assembly 820 of some embodiments. FIG. 14 provides an alternative staggered exploded view for the tension assembly 820 of some embodiments. The tension assembly 820 operates in conjunction with the three faceted binding anchor 810 and a tension rod 230 to secure the drum shell between the top shell mount 210 and the bottom shell mount 240 of the ultimount.

In some embodiments, each tension rod 230 is a hollowed shaft that contains an exterior thread and an interior thread at either end of the rod. In some embodiments, the tension rods 230 are made from metal, carbon fiber, or other rigid materials. Reference marker 1410 of FIG. 14 illustrates the exterior thread and reference marker 1420 points to the location of the interior thread. This configuration creates a two stage male-female coupling mechanism with which the tension rod 230 attaches and is secured to the anchor 810.

To complete the first stage of the male-female coupling mechanism, the exterior threaded end of the tension rod 230 screws through a first threaded nut 880, passes through a vertical aperture of the anchor 810, and is then secured at the other end of the anchor 810 with a second threaded nut 870. Completion of the first stage provides a loose coupling of the tension rod 230 to the anchor 810, thereby securing the tension rod 230 to the shell mount that the rod holder for the anchor is coupled to. The other exterior threaded end of the tension rod 230 is similarly secured to a rod holder that is coupled to the opposing shell mount using a complimentary second threaded nut 870. When the nuts 870 are tightened, the distance separating the shell mounts 210 and 240 is reduced, thereby compressing the drum shell disposed between the mounts 210 and 240. In some embodiments, the tension rod 230 can be screwed via nut 870 such that the end of the tension rod 230 is at least four centimeters away from the top of the anchor, thereby allowing for the distance between the two linked shell mounts 210 and 240 to differ by a total of eight centimeters. The distance separating the shell mounts 210 and 240 and the desired compression forced placed on the drum shell disposed in between can be specifically dialed using a torque wrench to tighten the nut 870. This customizability optimizes the ultimount framework for drum shells of different materials. For instance, the ultimount framework can be used with more brittle drum shells, such as those made of glass, by lessening the compression force on that shell, but the ultimount framework can also be used with more rigid drum shells, such as those made of wood, by increasing the compression force on that type of shell material.

Once the desired distance between the mounts 210 and 240 is achieved and a desired compression force is imposed on the drum shell using the second threaded nut 870 and the tension rod 230, the top bolt 860 of the tension assembly 820 is then used to lock the position of the second threaded nut 870 relative to the tension rod 230. The exterior thread of the top bolt 860 screws into the interior thread of the tension rod 230, thereby completing the second stage of the male-female coupling mechanism. Specifically, the top bolt 860 passes through the washer 865 and screws into the tension rod 230 until the endcap of the top bolt 860 presses underside of the washer 865 against the top of the second threaded nut 870. In so doing, the top bolt 860 prevents vibrations from altering the position of the second threaded nut 870 on the tension rod 230, thereby maintaining the distance separating the shell mounts 210 and 240 and, as a result, the compression force imposed on the drum shell by the coupling of the shell mounts using the tension rods 230 and the tension assembly 820. The washer 865 can be of varying thickness to enable the top bolt 860 to tighten when there is a gap in space between the second threaded nut 870 and the top bolt 865.

In some embodiments, the ultimount structure and design is adapted to incorporate different elements in addition to or instead of those described above. For example, in some embodiments, the tension rods can comprise shafts with only exterior threads, thereby eliminating the need for the top bolt 860.

As evident from the figures, the ultimount design only subjects the drum shell to a compression force based on the contact between the drum shell and the top 210 and bottom 240 shell mounts. In other words, the drum shell is subject to a y-axial force. However, there are no x-axial forces placed on the drum shell. Any such x-axial forces are placed on the top 210 and bottom 240 shell mounts based on the coupling of the rod holders 230 to the shell mounts. By removing the x-axial forces from the shell, the ultimount structural framework can be mounted on shells constructed from thinner materials than would normally be required for traditional drum mounts. Specifically, the ultimount structural framework supports drum shells made primarily of plastic, clay, or glass. These materials have different resonate properties than traditional wood, steel, or brass shells. Consequently, the ultimount opens the door to a new evolution in drum sound.

Some embodiments provide an enhanced rod holder assembly that further isolates energy transfer from the drumhead to the structural framework. Whereas the assembly of FIG. 8 provides energy absorption and vibration dampening along the horizontal plane at which the assembly couples to the drum shell mount, the enhanced rod holder assembly also incorporates energy absorption and vibration dampening elements along the vertical plane used to secure the tension rod to the assembly anchor. This further ensures that any energy transferred from the drumhead to the ultimount structural framework does not pass to the tension rods to cause any rattling or other distortion to the drum sound.

Figure 15:
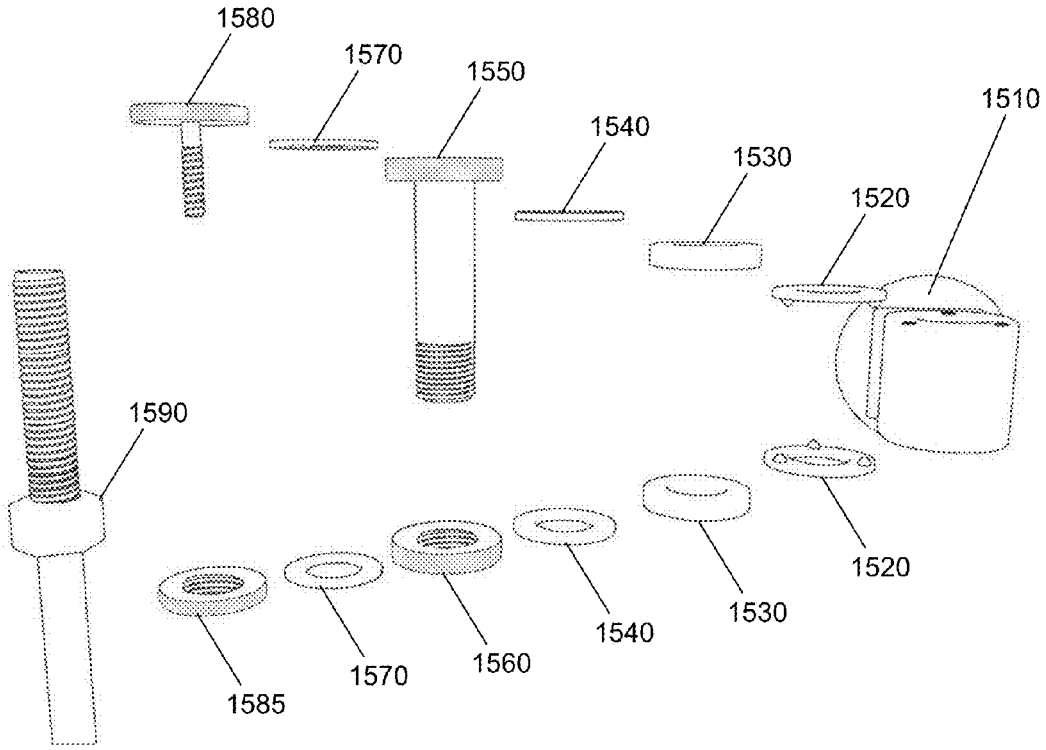
FIG. 15 illustrates an exploded view for the components of the enhanced rod holder assembly in accordance with some embodiments.
Figure 16:
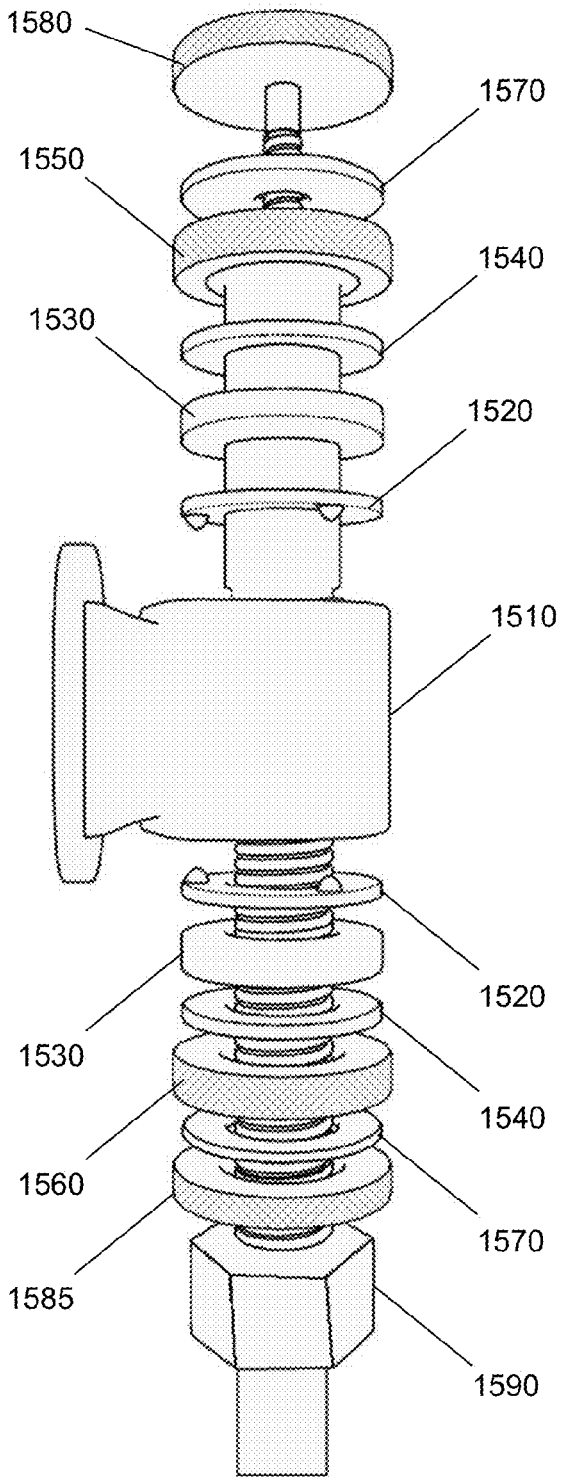
FIG. 16 illustrates assemblage of the enhanced rod holder assembly in accordance with some embodiments.

FIG. 15 illustrates an exploded view for the components of the enhanced rod holder assembly 1500 in accordance with some embodiments. FIG. 16 illustrates assemblage of the enhanced rod holder assembly 1500 in accordance with some embodiments. The enhanced rod holder assembly 1500 depicted in FIGS. 15 and 16 includes an anchor 1510, a pair of endcaps 1520, a pair of vibration absorbing bushings 1530, a first pair of washers 1540, a tension bolt 1550, a first outer nut 1560, a second pair of washers 1570, a lockdown bolt 1580, a second outer nut 1585, and a tension rod 1590. The parts are displayed according to their order of assembly. The parts that are displayed closest to the anchor 1510 are positioned and secured first and the parts that are furthest from the anchor 1510 are positioned and secured last.

Figure 17:
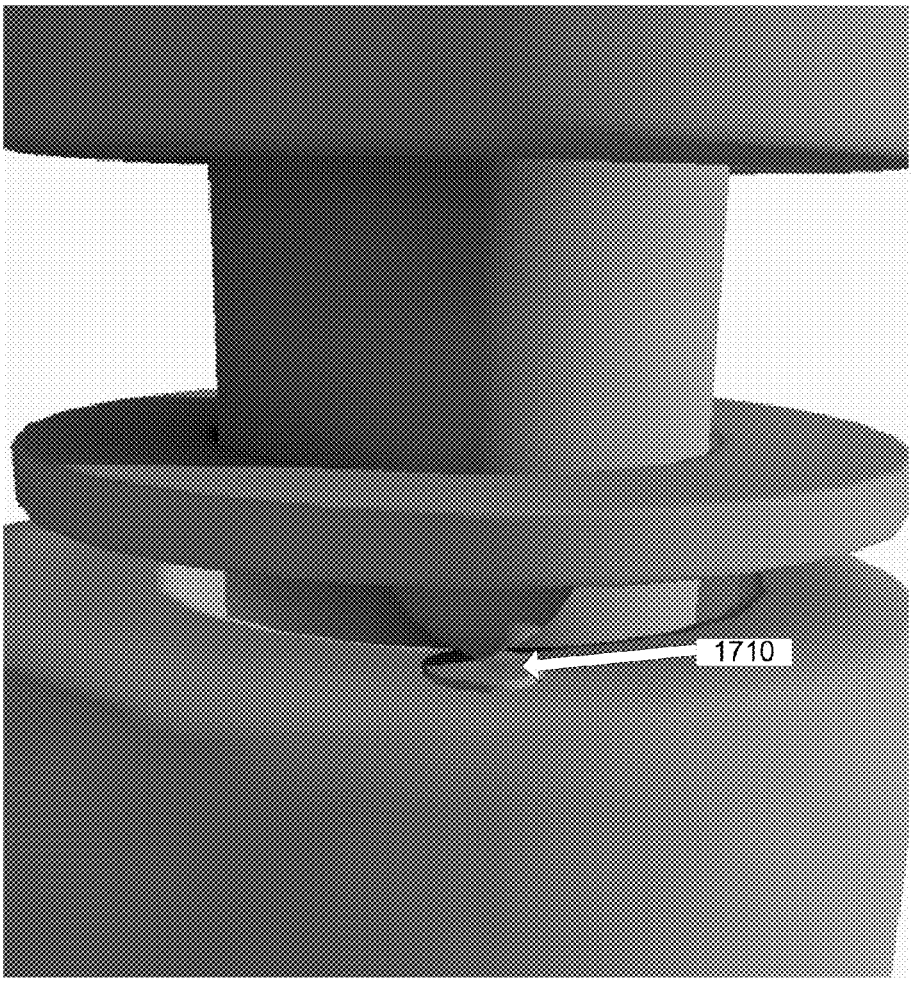
FIG. 17 illustrates the plugs within the anchor vertical recesses.

The anchor 1510 remains mostly unchanged from the three faceted binding anchor 810 of FIG. 8. The anchor 1510 includes a horizontal threaded aperture that secures to one of the drum shell mounts using the same or similar vibration dampening assembly 815 as FIG. 8. The anchor 1510 also includes the bilateral vertical apertures used in coupling and torquing the tension rod to the assembly 1500. In some embodiments, the anchor 1510 is modified to include several recesses along either vertical face. These recesses align with the prongs that protrude from the endcaps 1520. When the endcaps 1520 are placed on either vertical face of the anchor 1510, the surface area contact between the endcaps 1520 and anchor 1510 is minimized to the contact points between the endcap 1520 prongs and the anchor 1510 vertical recesses. By reducing the points of contact between the anchor 1510 and the endcap 1520, the design reduces the amount of energy that can transfer from the anchor 1510 to the vertical assembly components, and ultimately to the tension rod 1590 that couples to assembly 1500. To further reduce energy transfer, some embodiments incorporate plugs within the recesses. The plugs are made of an energy or vibration absorbing material. In some such embodiments, the endcap 1520 prongs press into the plugs with the plugs buffering the contact between the endcap 1520 prongs and the anchor 1510 vertical recesses. In this configuration, the contact between the endcaps 1520 and the anchor 1510 is again minimized to the contact points between the endcap 1520 prongs and the anchor 1510 vertical recesses with the added benefit of having the energy absorbing plugs in between those points of contact. FIG. 17 illustrates a plug 1710 within an anchor vertical recess in accordance with some embodiments.

The first pair of vibration absorbing bushings 1530 placed adjacent to the endcaps 1520 mitigate against further energy transfer, especially any energy that is transferred from the anchor 1510 to the endcaps 1520. These bushings 1530 are made of rubber, plastic, or other energy absorbing material. Accordingly, any energy that transfers from the anchor to the endcaps is dampened or entirely absorbed by the bushings 1530.

The first pair of washers 1540 are placed over the bushings 1530. The washers 1540 serve to distribute the load that is placed on the bushings 1530 by the vertical fastening elements of the assembly 1500.

Figure 18:
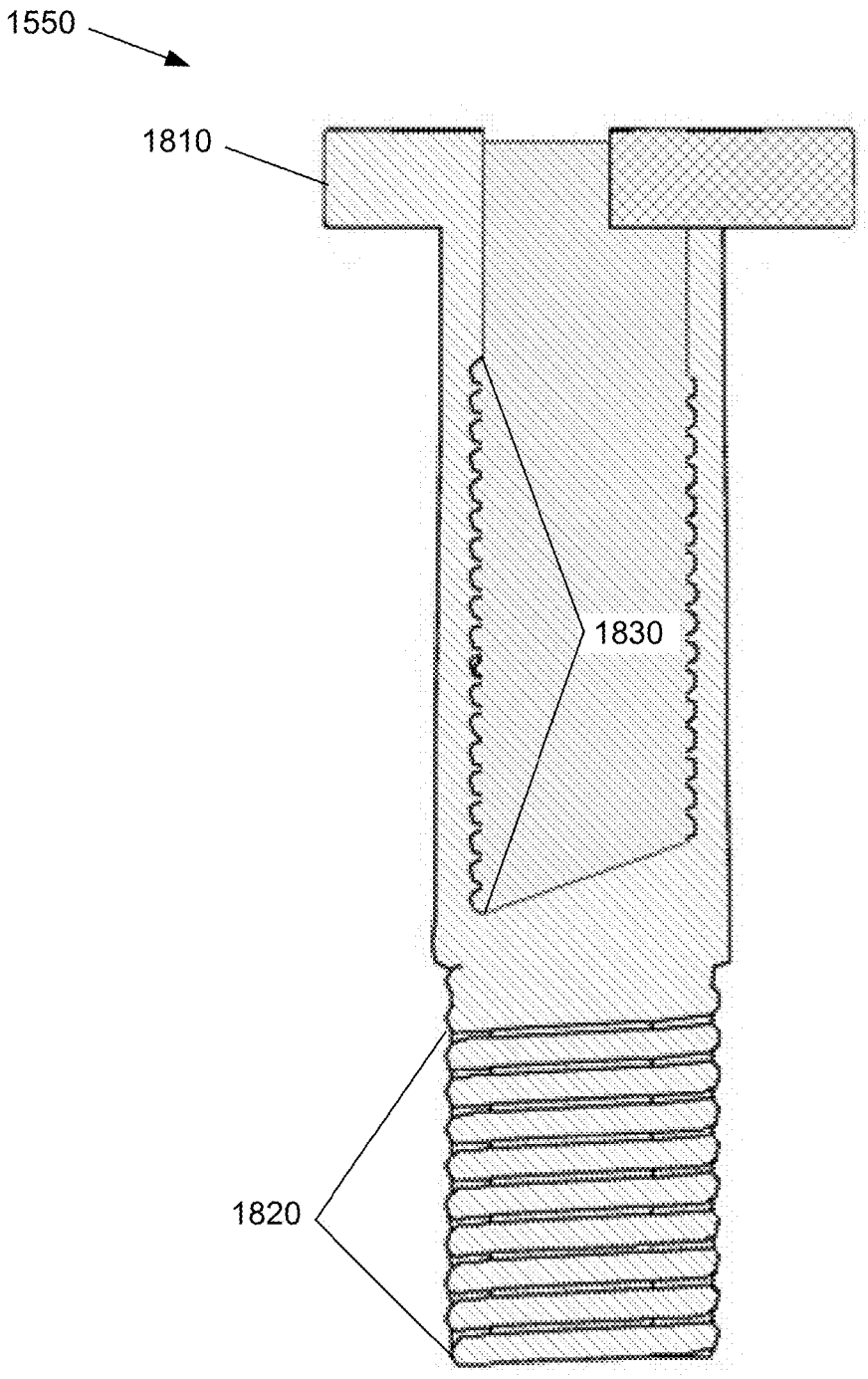
FIG. 18 illustrates a cross-section of the tension bolt.

The vertical fastening elements begin with the tension bolt 1550 and the first outer nut 1560. A cross-section of the tension bolt 1550 is provided in FIG. 18. As seen in FIG. 18, the tension bolt 1550 has an enlarged top 1810, a lower half extension with outer threading 1820, and a vertical cavity or hollowed shaft with inner threading 1830. The vertical cavity spans the full length of the bolt 1550. An aperture centrally located at the enlarged top 1810 provides access to the vertical cavity from the top end of the bolt 1550 and a complimentary aperture at the opposing end of the bolt 1550 provides access to the vertical cavity from the bottom end of the bolt 1550. As will be explained below, the cavity and the threading 1830 are the means with which the tension rod 1590 is coupled to the overall assembly 1500.

The tension bolt 1550 inserts through the top vertical aperture of the anchor 1510 such that a portion of the bolt's 1550 lower half extension passes through the bottom vertical aperture of the anchor 1510. The first outer nut 1560 is then used to secure the bolt 1550 to the anchor 1510. Once attached, the bolt 1550 serves as the coupling receiver for the tension rod 1590, and in combination with the anchor 1510, the bolt 1550 further serves as the torsion block against which the tension rod 1590 is torqued.

In some embodiments, the lower half extension or body of the tension bolt 1550 has a circumference that does not contact the interior of the anchor 1510 when the tension bolt 1550 is inserted into the anchor 1510. This is another design aspect that further mitigates the transfer of energy from the anchor 1500 to the tension bolt 1550, and ultimately to the tension rod 1590 that couples to the tension bolt 1550. In other words, the bolt 1550 never makes direct contact with the anchor 1550. Therefore, the energy that the anchor 1510 absorbs from the drumhead can only pass to the endcaps 1520 and the bushings 1530, each of which provide energy dampening or absorption, before there is any potential for indirect passage into the bolt 1550 and then the tension rod 1590.

Figure 19:
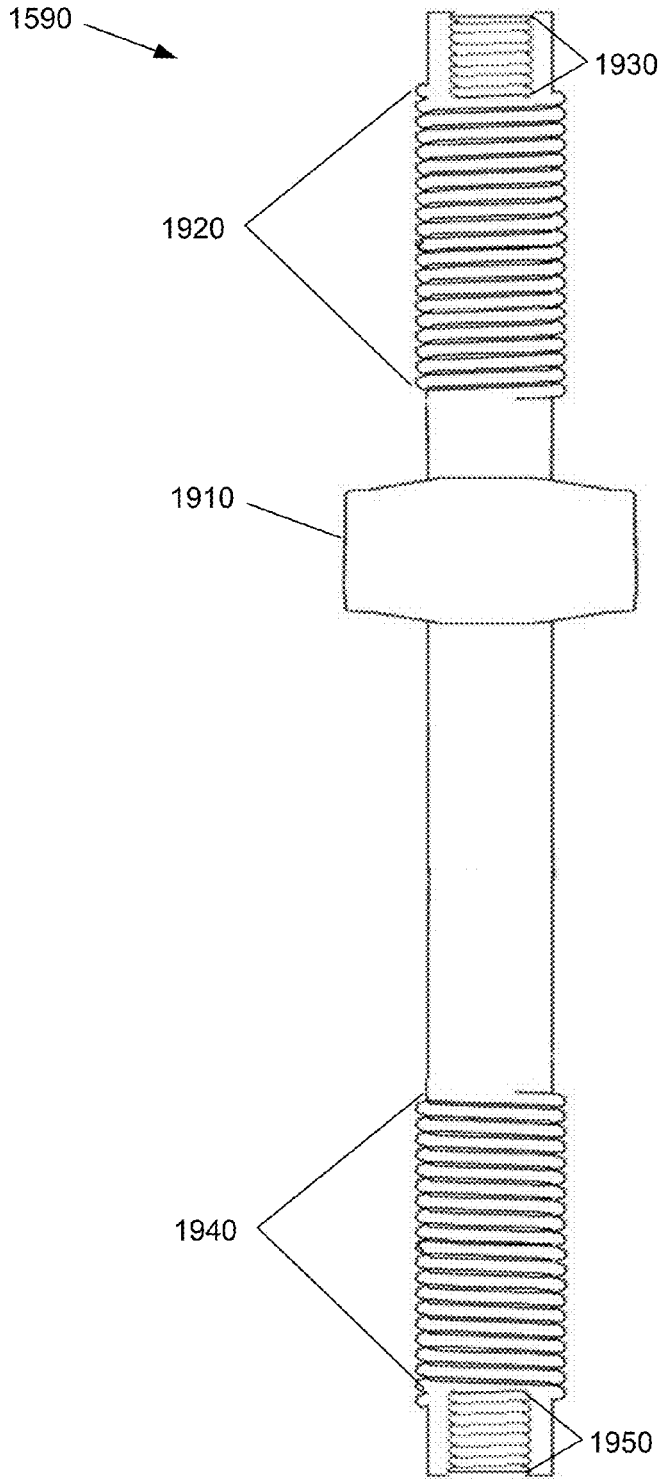
FIG. 19 illustrates the tension rod of some embodiments and further provides a partial cross-sectional view to better illustrate the coupling head at either end of the tension rod.

The tension rod 1590 is a long tubular extension with a specialized coupling head at each end of the rod 1590. FIG. 19 illustrates the tension rod 1590 of some embodiments and further provides a partial cross-sectional view to better illustrate the coupling head at either end of the tension rod 1590. The coupling head at the top end of the tension rod 1590 includes a hexagonal nut 1910, exterior threading 1920, and a hollowed shaft with inner threading 1930. The coupling head at the bottom end includes exterior threading 1940 that is opposing or inverted relative to the top end exterior threading 1920. The coupling head at the bottom end also includes a hollowed shaft with inner threading 1950 that is opposing or inverted relative to the top end inner threading 1930.

The opposing exterior threading 1920 and 1940 provides a vice-like function in conjunction with the tension bolt inner threading 1830. Specifically, when the tension rod 1590 is turned in a first direction, the exterior threading 1920 at the top end screws into the inner threading 1830 of a first tension bolt that is secured to a first anchor coupled to a top shell mount while the exterior threading 1940 at the bottom end simultaneously screws into the inner threading 1830 of a second tension bolt that is secured to a second anchor coupled to a bottom shell mount. This draws the first anchor closer to the second anchor which in turn increases the pressure that is exerted on a drum shell disposed between the top shell mount and the bottom shell mount. Turning the tension rod 1590 in an opposite second direction will unscrew the tension rod 1590 exterior threading 1920 and 1940 from the tension bolts 1550 inner threading 1830, thereby increasing the distance between the top and bottom shell mounts and reducing the pressure on the drum shell.

Figure 20:
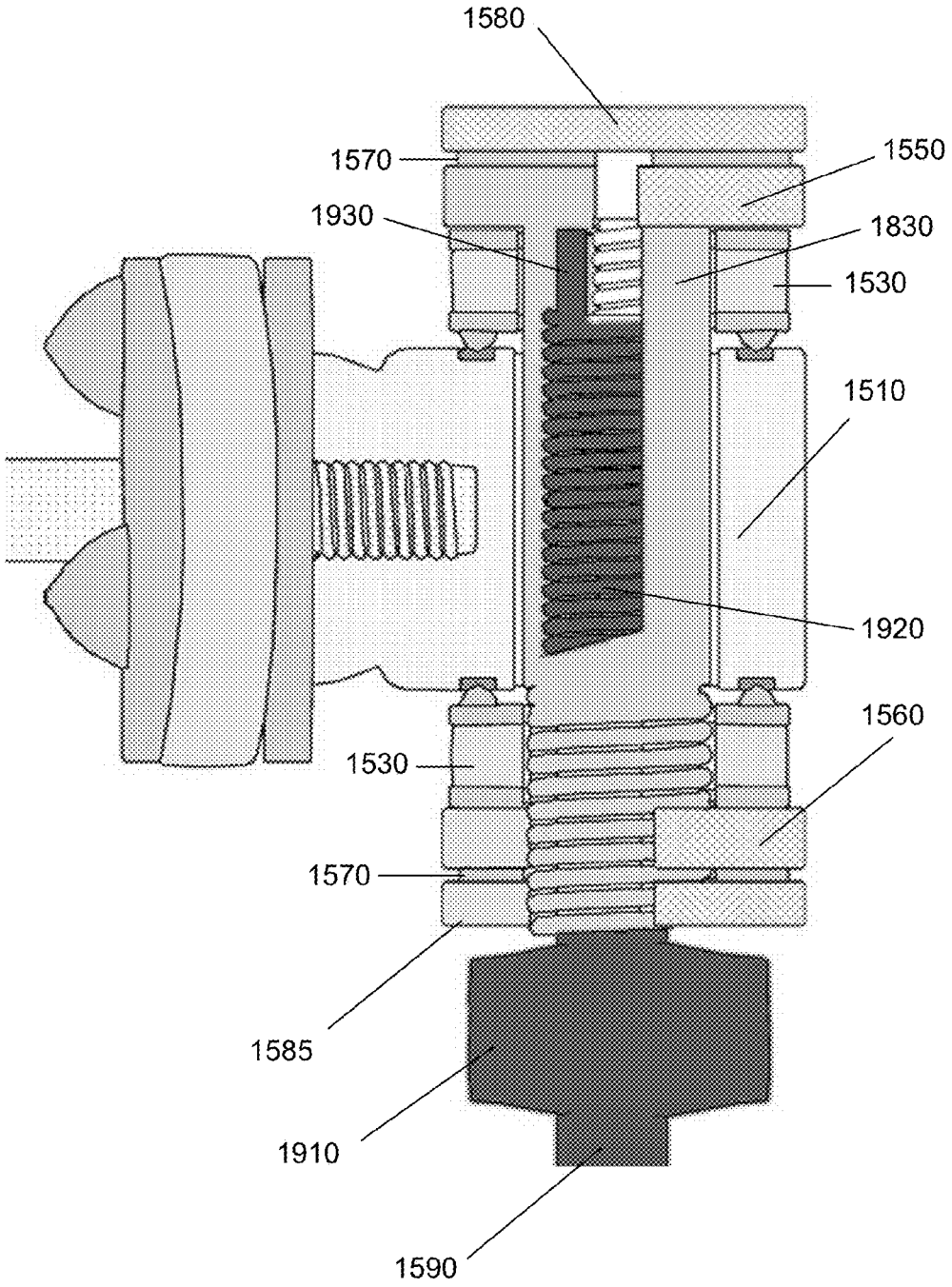
FIG. 20 provides a cutaway illustration for the coupling of one end of the tension rod to a tension bolt.

The coupling of one end of the tension rod 1590 to a tension bolt 1550 is best illustrated by the cutaway illustration of FIG. 20. As shown in FIG. 20, the tension bolt 1550 passes through the anchor 1510 with the first outer nut 1560 attached to the exterior threading of the bolt's 1550 lower half extension. The second pair of washers 1570 are then placed atop the tension bolt 1550 and the downward face of the first outer nut 1560. A second outer nut 1585 secures one of the second pair of washers 1570 against the first outer nut 1560. The tension rod 1590 is then inserted up through the bottom vertical aperture of the tension bolt 1550 until the exterior threaded end 1920 of the tension rod 1590 comes into contact with the inner threading 1830 within the tension bolt 1550 vertical cavity (not shown in FIG. 20). At this point, the hexagonal nut 1910 or body of the tension rod 1590 can be used to screw the tension rod 1590 into the inner threading of the tension bolt 1550, thereby coupling the two structures together. As described above, the tension rod 1590 will be coupled at either end to different tension bolts 1550 that are themselves coupled to different anchors 1510 that in turn are coupled to a top shell mount and a bottom shell mount. Every turn of the tension rod 1590 drives the tension rod 1590 further into the tension bolts 1550 coupled at either end of the tension rod 1590, thereby reducing the distance separating the anchors 1510 that are coupled to the tension bolts 1550 and, as such, reducing the distance separating the top shell mount and the bottom shell mount to which the anchors 1510 are themselves coupled. The hexagonal nut 1910 is provided to aid in torquing the tension rod 1590 into the tension bolts 1550. This allows a user to dial-in a pressure on the drum shell by finely adjusting the distance between the top shell mount and the bottom shell mount of the drum shell.

The position of the tension rod 1590 within the tension bolt 1550 can be fixed using the lockdown bolt 1580. The lockdown bolt 1580 passes through the vertical aperture along the top face of the tension bolt 1550. The lockdown bolt 1580 has an enlarged top and vertical extension with exterior threading that screws into the inner threading 1930 of the tension rod 1590. To secure the position of the tension rod 1590, the lockdown bolt 1580 is screwed into the inner threading 1930 of the tension rod 1590 until the enlarged top of the lockdown bolt 1580 abuts the enlarged top of the tension bolt 1550. In this position, the lockdown bolt 1580 prevents further adjustments to the tension rod 1590. In other words, the tension rod 1590 position within a corresponding tension bolt 1550 is fixed, thereby fixing the distance between two horizontally aligned but vertically separated anchors 1510, and in turn fixing an amount of pressure that is exerted on a drum shell mounted by a top shell mount and a bottom shell mount that are coupled to the vertically separated anchors 1510.

Figure 21:
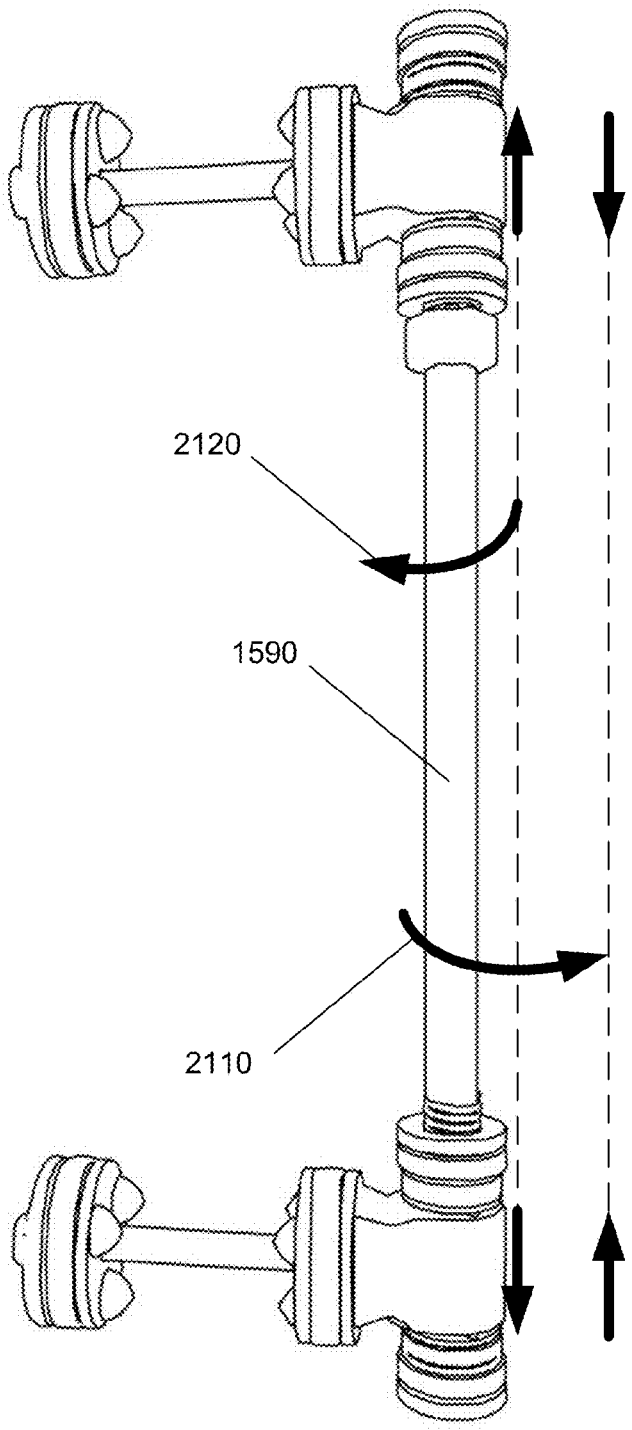
FIG. 21 illustrates a completed assembly in which either end of the tension rod is coupled to different enhanced rod holders.

FIG. 21 illustrates a completed assembly in which either end of the tension rod 1590 is coupled to different enhanced rod holders. The figure further illustrates how turning the tension rod 1590 in a first direction 2110 reduces the distance separating the rod holders and turning the tension rod 1590 in an opposite second direction 2120 increases the distance separating the rod holders.

I claim:

1. A mounting and tuning system comprising:

an anchor comprising (i) a threaded horizontal cavity and (ii) a vertical cavity;

a tension bolt comprising an enlarged top with an aperture and a body extending downwards from the enlarged top, the body having outer threading and a hollowed shaft within the tension bolt body, the hollowed shaft comprising inner threading;

a nut securing the tension bolt to the anchor by insertion of the tension bolt body through one end of the anchor vertical cavity and by screwing the nut to the body outer threading extending through an opposite end of the anchor vertical cavity; and a tension rod comprising a tubular extension with outer threading, wherein the tension rod couples to the tension bolt by screwing the tension rod outer threading to the inner threading of the tension bolt hollowed shaft.

2. The mounting and tuning system of claim 1, wherein the tension rod further comprises a hollowed shaft extending within the tubular extension with the hollowed shaft comprising inner threading.

3. The mounting and tuning system of claim 2 further comprising a lockdown bolt, the lockdown bolt comprising an enlarged top and a body with outer threading that passes through the tension bolt hollowed shaft and screws into the inner threading of the tension rod hollowed shaft.

4. The mounting and tuning system of claim 1 further comprising a pair of bushings with a first bushing disposed between the tension bolt enlarged top and a top of the anchor and a second bushing disposed between a bottom of the anchor and the tension rod, said pair of bushings operating to reduce energy transfer from the anchor to the tension rod.

5. The mounting and tuning system of claim 1 further comprising a pair of endcaps having a plurality of protrusions with a first endcap disposed between the tension bolt enlarged top and a top of the anchor and a second endcap disposed between a bottom of the anchor and the tension rod, said pair of endcaps contacting the anchor with the plurality of protrusions to minimize surface area over which energy can transfer from the anchor to the tension rod.

6. The mounting and tuning system of claim 1, wherein the anchor horizontally couples to a drum shell mount using the threaded horizontal cavity.

7. The mounting and tuning system of claim 1, wherein the tension rod comprises outer threading at either end of the tubular extension, wherein outer threading at one end of the tubular extension couples to a tension bolt that is coupled to an anchor that is coupled to a top drum shell mount and outer threading at an opposite end of the tubular extension couples to a tension bolt that is coupled to an anchor that is coupled to a bottom drum shell mount.

8. The mounting and tuning system of claim 1, wherein an amount by which the tension rod outer threading screws into the inner threading of the tension bolt hollowed shaft configures an exposed length of the tension rod.

9. A drum mounting and tuning system comprising:

a top shell mount configured to mount over a first edge of a drum shell;

a bottom shell mount configured to mount over a second opposite edge of the drum shell;

at least first and second anchors, each of the first and second anchors comprising a threaded horizontal cavity and a vertical cavity, wherein the first anchor couples to a circumferential face of the top shell mount using the threaded horizontal cavity of the first anchor and the second anchor couples to a circumferential face of the bottom shell mount using the threaded horizontal cavity of the second anchor;

at least first and second tension bolts, each of the first and second of tension bolts comprising a body with outer threading and a hollowed shaft extending a length of the body, the hollowed shaft comprising inner threading;

at least first and second nuts with the first nut screwing onto the outer threading at a bottom end of the first tension bolt that passes from a top end of the first anchor vertical cavity through a bottom end of the first anchor vertical cavity and with the second nut screwing onto the outer threading at a bottom end of the second tension bolt that passes from a top end of the second anchor vertical cavity through a bottom end of the second anchor vertical cavity; and at least one particular tension rod comprising outer threading at a proximal end and distal end of the particular tension rod, wherein the proximal end outer threading screws into the inner threading of the hollowed shaft of the first tension bolt that is secured to the first anchor using the first nut, and wherein the distal end outer threading screws into the inner threading of the hollowed shaft of the second tension bolt that is secured to the second anchor using the second nut, and wherein pressure on the drum shell is adjusted by turning the particular tension rod in one direction to reduce distance between the first anchor and the second anchor.

10. The drum mounting and tuning system of claim 9 further comprising a shell disposed between the top shell mount and the bottom shell mount and wherein sound produced by resonance of the shell is configurable by turning the particular tension rod.

11. The drum mounting and tuning system of claim 9, wherein turning the particular tension rod in an opposite direction increases distance between the first anchor and the second anchor, thereby decreasing compression forces on the drum shell.

12. The drum mounting and tuning system of claim 9 further comprising a bolt that passes through an aperture along a circumferential face of the top shell mount and screws into the threaded horizontal cavity of the first anchor.

13. The drum mounting and tuning system of claim 9 further comprises an endcap with a plurality of prongs disposed between the first tension bolt and a top face of the first anchor, the endcap reducing energy transfer from the anchor to the first tension bolt by reducing surface contact between the tension bolt and the anchor to the plurality of prongs.

14. The drum mounting and tuning system of claim 13 further comprising a dampener disposed between the first tension bolt and the endcap, the dampener reducing energy transfer from the anchor to the first tension bolt.

15. The drum mounting and tuning system of claim 9, wherein the proximal end of the particular tension rod comprises a hollowed shaft with inner threading.

16. The drum mounting and tuning system of claim 15 further comprising a lockdown bolt comprising (i) an enlarged top preventing the lockdown bolt from passing fully through the first tension bolt hollowed shaft and (ii) an outer threaded extension extending from the enlarged top that screws into the hollowed shaft inner threading of the particular tension rod, thereby preventing the particular tension from screwing further into the first tension bolt.

* * * * *